US010760391B2

(12) United States Patent
Aguilera et al.

(10) Patent No.: US 10,760,391 B2
(45) Date of Patent: Sep. 1, 2020

(54) METHOD FOR RECOVERING HYDROCARBONS FROM LOW PERMEABILITY FORMATIONS

(71) Applicants: NEXEN ENERGY ULC, Calgary (CA); Roberto Aguilera, Calgary (CA); Alfonso Fragoso, Calgary (CA); Yi Wang, Calgary (CA); Guicheng Jing, Calgary (CA)

(72) Inventors: Roberto Aguilera, Calgary (CA); Alfonso Fragoso, Calgary (CA); Yi Wang, Calgary (CA); Guicheng Jing, Calgary (CA); Karthikeyan Selvan, Calgary (CA); Thomas Harding, Calgary (CA); Faisal Qureshi, Calgary (CA)

(73) Assignee: CNOOC PETROLEUM NORTH AMERICA ULC, Calgary (CA)

( * ) Notice: Subject to any disclaimer, the term of this patent is extended or adjusted under 35 U.S.C. 154(b) by 89 days.

(21) Appl. No.: 15/776,139

(22) PCT Filed: Nov. 16, 2016

(86) PCT No.: PCT/CA2016/000279
§ 371 (c)(1),
(2) Date: May 15, 2018

(87) PCT Pub. No.: WO2017/083954
PCT Pub. Date: May 26, 2017

(65) Prior Publication Data

US 2018/0347328 A1 Dec. 6, 2018

Related U.S. Application Data

(60) Provisional application No. 62/255,964, filed on Nov. 16, 2015.

(51) Int. Cl.
*E21B 43/40* (2006.01)
*E21B 43/16* (2006.01)
(Continued)

(52) U.S. Cl.
CPC ..... *E21B 43/168* (2013.01); *E21B 43/126* (2013.01); *E21B 43/18* (2013.01);
(Continued)

(58) Field of Classification Search
CPC ..... E21B 43/18; E21B 43/40; E21B 43/295; E21B 43/385; E21B 43/166; E21B 43/168; E21B 27/00
See application file for complete search history.

(56) References Cited

U.S. PATENT DOCUMENTS 3,903,967 A 9/1975 Woodward
4,099,568 A * 7/1978 Allen ..... C09K 8/592 166/269
(Continued)

FOREIGN PATENT DOCUMENTS

WO 2006113982 A1 11/2006

OTHER PUBLICATIONS

WIPO, International Search Report and Written Opinion for PCT Application No. PCT/CA2016/000279 dated Jan. 4, 2017.

*Primary Examiner* — Kenneth L Thompson
(74) *Attorney, Agent, or Firm* — Norton Rose Fulbright Canada LLP

(57) ABSTRACT

There is provided a method of producing hydrocarbon material. A first hydrocarbon material is produced from the formation, the first hydrocarbon material including a gaseous hydrocarbon material originally in place in the formation. At least a portion of the produced gaseous hydrocarbon
(Continued)

material is injected into the formation to increase the formation pressure. A second hydrocarbon material is produced from the formation.

24 Claims, 19 Drawing Sheets

(51) Int. Cl.

| | |
|---|---|
| ***E21B 43/25*** | (2006.01) |
| ***E21B 43/18*** | (2006.01) |
| ***E21B 43/12*** | (2006.01) |
| *E21B 47/06* | (2012.01) |

(52) U.S. Cl.
CPC ..... *E21B 43/25* (2013.01); *E21B 43/40* (2013.01); *E21B 47/06* (2013.01)

(56) References Cited

U.S. PATENT DOCUMENTS

| | | | | |
|---|---|---|---|---|
| 4,635,721 | A * | 1/1987 | Sheffield | E21B 43/168 166/268 |
| 6,209,641 | B1 * | 4/2001 | Stevenson | E21B 43/124 166/105.5 |
| 6,691,781 | B2 | 2/2004 | Grant et al. | |
| 7,938,182 | B2 * | 5/2011 | Turta | E21B 43/164 166/266 |
| 10,066,469 | B2 * | 9/2018 | Graff | E21B 43/166 |
| 2015/0053401 | A1 | 2/2015 | Khaledi et al. | |
| 2017/0283688 | A1 * | 10/2017 | Valencia | C09K 8/58 |

* cited by examiner

METHOD FOR RECOVERING HYDROCARBONS FROM LOW PERMEABILITY FORMATIONS

CROSS-REFERENCE TO RELATED APPLICATIONS

This application claims the benefit of U.S. 62/255,964 filed Nov. 16, 2016, which is herein incorporated by reference.

FIELD

This invention is directed to a method of recovering hydrocarbons from low permeability reservoirs. Specifically, this invention is directed to a method of producing gases originally in place in the reservoir, and injecting the gases back into in the reservoir.

BACKGROUND

There has been an increasing interest in the recovery of hydrocarbon materials from low and ultra-low permeability formations, such as tight oil and shale formations. Many wells have been drilled and completed in shale formations, such as the Eagle Ford Shale in the southern United States and the Duvernay Formation in western Canada. Some of these formations have been found to have an "upside down" distribution of fluids, where oil is in the shallowest zones, condensate in the middle, and dry gas is on the bottom of the structure. Further, unconventional distributions of fluids have been observed in tight formations such as the Nikanassin formation in western Canada, where gas is above an oil in the shallower zones, water is in a middle zone and additional gas is present on the bottom of the structure.

Due to their low permeability, there are many challenges in recovering of hydrocarbon material from such formations. Techniques, such as hydraulic fracturing, have been used to increase recovery of the hydrocarbons from these formations.

There exists a need for improved methods for recovering hydrocarbon materials from such formations.

SUMMARY

In one aspect, there is provided a method of producing hydrocarbon material. A first hydrocarbon material is produced from the formation, the first hydrocarbon material including a gaseous hydrocarbon material originally in place in the formation. At least a portion of the produced gaseous hydrocarbon material is injected into the formation to increase the formation pressure. A second hydrocarbon material is produced from the formation.

In some embodiments, a gas-rich stream is separated from the first hydrocarbon material, wherein the injected gaseous hydrocarbon material includes the gas-rich stream.

In some embodiments, the injected gaseous hydrocarbon material comprises: 70-100 vol % methane; 5-20 vol % ethane; 5-20 vol % propane; and 0-10 vol % hexane, based on the total volume of the injected gaseous hydrocarbon material.

In some embodiments, the formation is a shale formation or a tight formation.

In some embodiments, the injecting of the at least a portion of the produced gaseous hydrocarbon material is effected while the producing of the second hydrocarbon material is being effected.

In some embodiments, injecting of the at least a portion of the produced gaseous hydrocarbon material is effected for at least 1 month.

In some embodiments, the injecting of the at least a portion of the produced gaseous hydrocarbon material is suspended before the producing of the second hydrocarbon material.

In some embodiments, the injecting of the at least a portion of the produced gaseous hydrocarbon material is effected for 100 days before the injecting is suspended and the producing of the second hydrocarbon material is effected for 100 days.

In some embodiments, the injecting of the at least a portion of the produced gaseous hydrocarbon material and the producing of the second hydrocarbon material is repeated. In some embodiments, the injecting of the at least a portion of the produced gaseous hydrocarbon material and the producing of the second hydrocarbon material is repeated at least once, at least twice, at least 5 times, at least 10 times, at least 25 times, at least 50 times at least 100 times, at least 250 times, or at least 500 times.

In some embodiments, the injecting of the at least a portion of the produced gaseous hydrocarbon material is into a condensate container disposed in the container, and the producing of the second hydrocarbon material is from the condensate container.

In some embodiments, the injected gaseous hydrocarbon material comprises: 70-100 vol % methane; 5-20 vol % ethane; 5-20 vol % propane; and 0-10 vol % hexane, based on the total volume of the injected gaseous hydrocarbon material.

In some embodiments, the injecting increases the pressure in the condensate container to at least the dew point of the second hydrocarbon material.

In some embodiments, the producing of the first hydrocarbon material is from the condensate container disposed within the formation, a gas container disposed within the formation, or a combination thereof.

In some embodiments, the condensate container has a permeability of from about 250 nanodarcys to about 0.1 millidarcys.

In some embodiments, the injecting of the at least a portion of the produced gaseous hydrocarbon material includes injecting into an oil container disposed in the container and the producing of the second hydrocarbon material includes producing from the oil container.

In some embodiments, the injected gaseous hydrocarbon material comprises: 70-100 vol % methane; 5-20 vol % ethane; 5-20 vol % propane; and 0-10 vol % hexane, based on the total volume of the injected gaseous hydrocarbon material.

In some embodiments, the producing of the first hydrocarbon material includes producing from a condensate container disposed within the formation, a gas container disposed within the formation, or a combination thereof.

In some embodiments, the injecting of the at least a portion of the produced gaseous hydrocarbon material decreases the viscosity of the second hydrocarbon material by at least 50% as compared to the initial viscosity of the second hydrocarbon material.

In some embodiments, the oil container has a permeability of from about 0.001 millidarcys to about 0.1 millidarcys.

In some embodiments, hydraulic fracturing of the oil container is effected prior to production of the first hydrocarbon material.

In one aspect, there is provided a method of producing hydrocarbon material from a formation. A gaseous hydrocarbon material is injected into a container disposed within the formation. Hydrocarbon material is produced from the container.

In some embodiments, the container is an oil container. In some embodiments, the container is a condensate container.

In some embodiments, the injected gaseous hydrocarbon material includes gaseous hydrocarbon material originally in place in the formation.

DETAILED DESCRIPTION

As used herein, the following terms have the following meanings:

"Hydrocarbon" is an organic compound consisting primarily of hydrogen and carbon, and, in some instances, may also contain heteroatoms such as sulfur, nitrogen and oxygen.

"Hydrocarbon material" is material that consists of one or more hydrocarbons.

"Container" is a portion of a reservoir system which responds as a unit when fluid is withdrawn. Hydrocarbon material disposed within a container exhibits low migration into adjacent containers. For example, a gas, a gas-condensate and an oil will typically separate, due to differences in density, with the oil settling on the bottom, the gas-condensate settling in the middle, and the gas settling on top. However, in an exemplary shale formation including a gas container having a gas, a gas-condensate container having a gas-condensate and an oil container having an oil, where the gas container is situated below the gas-condensate container and the gas-condensate is situated below the oil container, the gas, the gas-condensate, and the oil tend to maintain their relative positions with the gas on the bottom, the gas-condensate in the middle, and the oil on top. For example, in simulations of formations having containers disposed therein, the effects of gravity segregation were minimal over a 1 million year simulation period, with the hydrocarbon material maintaining the inverted disposition. Exemplary formations exhibiting "containers" include formations having low matrix permeability and/or low natural fracturing. In an exemplary tight oil formation including a gas container having a gas, a water container having water, and an oil-gas container having a gas and an oil, where the gas container is situated below the water container and the water container is situated below the oil-gas container, the gas, the water, and the oil and gas tend to maintain their relative positions with the gas on the bottom, the water in the middle, and the oil and gas on top. In the oil-gas container, both oil and gas are present and separate into two phases. Formations having low natural fracturing often exhibit large distances between adjacent fractures exemplifying low natural fracturing. For example, the adjacent fractures can be 2-50 m apart. Additional properties useful for identifying containers include burial depth, temperature and vitrinite reflectance.

Figure 1:
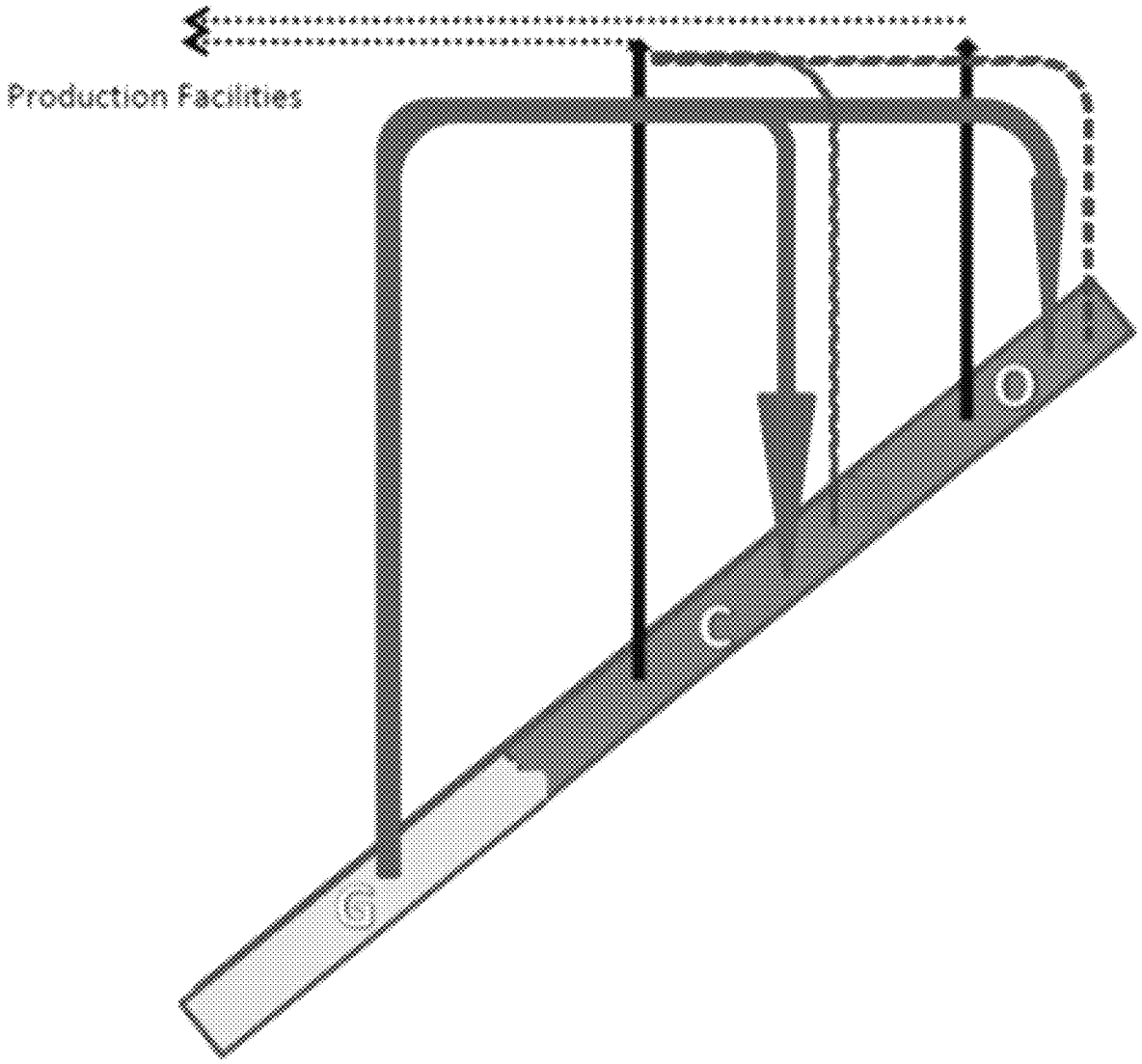
FIG. 1 provides an exemplary schematic diagram according to an embodiment of the invention.

Having reference to FIG. 1, in one aspect, there is provided a method of capturing hydrocarbon material from a formation. A first hydrocarbon material from the formation is produced, the first hydrocarbon material including a gaseous hydrocarbon material originally in place in the formation. At least a portion of the gaseous hydrocarbon material is injected into the formation to increase the formation pressure. A second hydrocarbon material is then produced from the formation.

The gaseous hydrocarbon material originally in place in the formation is gaseous hydrocarbon that is present in the formation prior to any production from the formation. The portion of the gaseous hydrocarbon material originally in place in the formation that is injected into the formation is "recycled" or "re-injected" into the formation to increase the pressure in the formation. Gaseous hydrocarbon material initially obtained elsewhere, such as from a third party or from another formation, and injected into the formation is not considered originally in place in the formation, even if it is subsequently produced from and re-injected into the formation. In some embodiments, injecting gaseous hydrocarbon material originally in place and produced from the formation may be more economical than injecting gaseous hydrocarbon material obtain elsewhere, such as from a third party supplier. For example, costs associated with obtaining and transporting such injected gas can be decreased.

In some embodiments, at least 10% of the injected gaseous hydrocarbon material is gaseous hydrocarbon material originally in place in the formation. In some embodiments, at least 50% of the injected gaseous hydrocarbon material is gaseous hydrocarbon material originally in place in the formation. In some embodiments, at least 75% of the injected gaseous hydrocarbon material is gaseous hydrocarbon material originally in place in the formation. In some embodiments, at least 90% of the injected gaseous hydrocarbon material is gaseous hydrocarbon material originally in place in the formation. In some embodiments, at least 95% of the injected gaseous hydrocarbon material is gaseous hydrocarbon material originally in place in the formation. In some embodiments, at least 99% of the injected gaseous hydrocarbon material is gaseous hydrocarbon material originally in place in the formation.

In some embodiments, the first hydrocarbon material is in a gaseous state at pressures within the formation, such as within a condensate container, while at lower pressures, for example at surface pressure, at least a portion of the first hydrocarbon material condenses into a liquid phase (e.g. the hydrocarbon material from a condensate container may undergo retrograde condensation at surface pressures). In some embodiments, for example, hydrocarbon material that is produced from a condensate container is separated into a gas-rich stream (e.g. a "dry gas") and a liquid-rich stream. In some embodiments, the injected hydrocarbon material includes at least a portion of the gas-rich stream (e.g. the gas-rich stream is recycled).

In some embodiments, the first hydrocarbon material is in a gaseous state at pressures within the formation, such as within a gas container, and remains in a gaseous state at lower pressures, such as surface pressure. In some embodiments, the permeability of the gas container is from about 100 nanodarcys to about 0.01 millidarcys. In some embodiments, the permeability of the gas container is about 682 nanodarcys.

In some embodiments, the first hydrocarbon material is produced from a condensate container disposed within the formation, a gas container disposed within the formation, or a combination thereof. In some embodiments, the injected gaseous hydrocarbon material includes at least a portion of the gas-rich stream separated from the hydrocarbon material produced from a condensate container disposed within the formation, a gaseous hydrocarbon material from the hydrocarbon material produced from a gas container disposed within the formation, or a combination thereof. In some embodiments, the injected gaseous hydrocarbon material consists of at least a portion of the gas-rich stream separated from the hydrocarbon material produced from a condensate container disposed within the formation, at least a portion of a gaseous hydrocarbon material produced from a gas container disposed within the formation, or a combination thereof.

In some embodiments, at least one well produces hydrocarbon material from a gas container, a condensate container, a gas container, or a combination thereof. Each of the at least one well may, independently, have a vertical or deviated orientation in the formation. In some embodiments, each of the at least one well produces hydrocarbon material from one container. In some embodiments, each of the at least one well produces hydrocarbon material from only one container. By producing from only producing from only one container, the composition of hydrocarbon material produced may be more predictable, the well completion may be less complicated (e.g. since additional tubulars may not be required), and there may be fewer regulatory requirements.

In some embodiments, the 20-year recovery factor of hydrocarbon material from a container by primary recovery (e.g. without injection of gaseous hydrocarbon material) is under 8%, or even under 5%. In some embodiments injection of gaseous hydrocarbon material increases the recovery factor of hydrocarbon material from the container. For example, the 20-year recovery factor of hydrocarbon material from a container where gaseous hydrocarbon material originally in place in the formation is injected into the container may be increased to from about 15% to about 45%.

Figure 2:
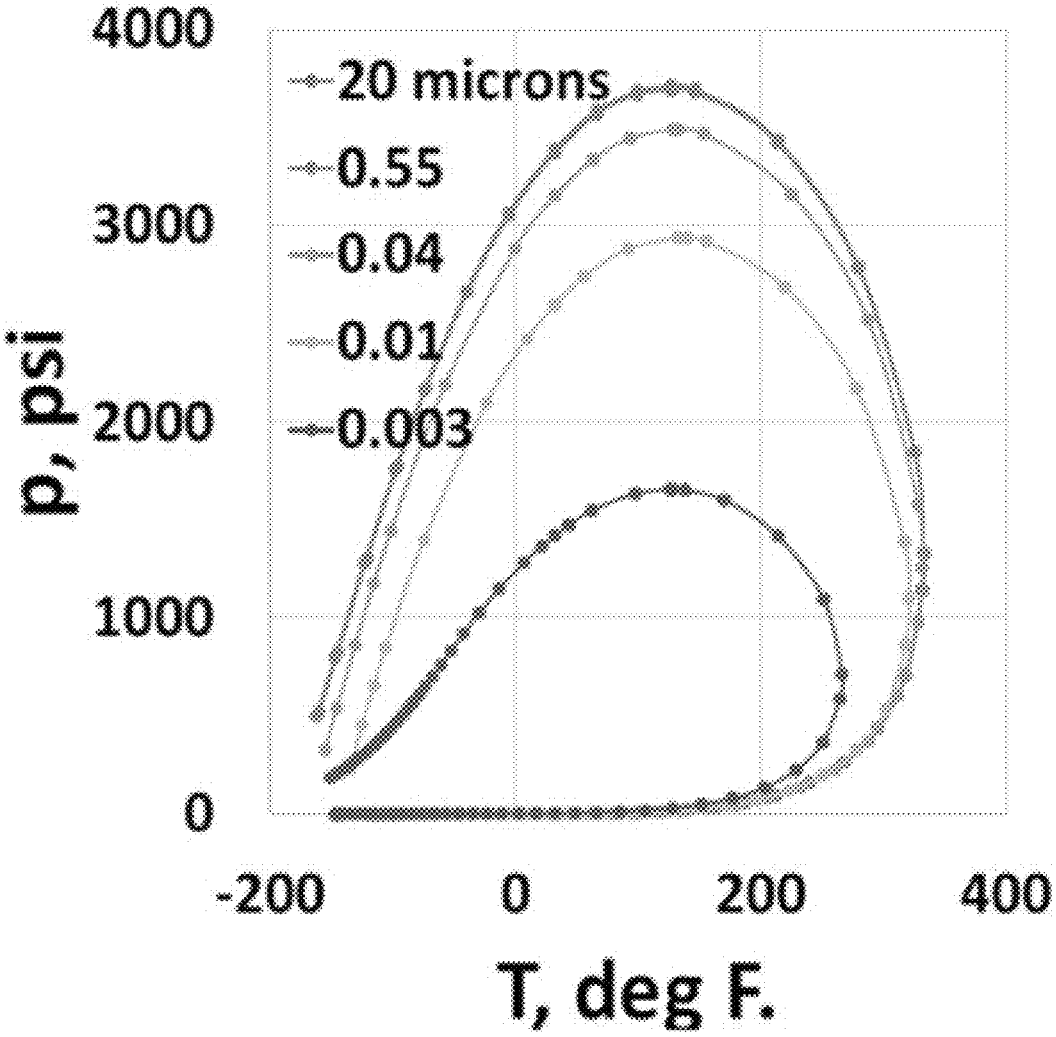
FIG. 2 provides an exemplary phase diagram of condensate in a condensate container according to an embodiment of the invention.

FIG. 2 provides an exemplary pressure-temperature phase diagram of a gas-condensate inside a condensate container. In some embodiments, the initial pressure in the condensate container is above the dew point pressure of the hydrocarbon material disposed within the condensate container. At such pressures, the hydrocarbon material is present in a gaseous state. In some embodiments, pressure in at least a portion of the condensate container is initially below the dew point and pressure in the remainder of the condensate container is initially at or above the dew point. For example, As hydrocarbon material is produced from the condensate container, pressure within the condensate container decreases. If the pressure in the condensate container decreases to or below the dew point pressure, a portion of the gaseous hydrocarbon material condenses into a liquid state. Hydrocarbon material that condenses into a liquid while the hydrocarbon material is still disposed within the condensate container may be difficult to recover. For example, in small amounts, such hydrocarbon material may become trapped within the pores of the container (e.g. by capillary forces). Further, such hydrocarbon material may obstruct pore throats, impairing the production of gaseous hydrocarbon material from the condensate container. In larger amounts, the hydrocarbon material that condenses within a condensate container may form a "condensate bank", which collects at or near the wellbore, further impairing the production of the hydrocarbon material from the condensate container.

In some embodiments, the initial pressure within the condensate container is from about 2000 psi to about 15000 psi. In some embodiments, the initial pressure within the condensate container is from about 3000 psi to about 8000 psi. In some embodiments, the initial pressure within the condensate container is about 5000 psi.

In some embodiments, the dew point pressure of the hydrocarbon material within the condensate container is from about 1200 psi to about 135000 psi. In some embodiments, the dew point pressure of the hydrocarbon material within the condensate container is from about 1800 psi to about 7200 psi. In some embodiments, the dew point pressure of the hydrocarbon material within the condensate container is about 3000 psi to about 4500 psi.

In some embodiments, the permeability of the condensate container is from about 250 nanodarcys to about 0.1 millidarcys. In some embodiments, the permeability of the condensate container is about 585 nanodarcys. In some embodiments, the permeability of the condensate container is about 0.07 millidarcys.

In some embodiments, the porosity of the condensate container is from about 3% to about 30%. In some embodiments, the porosity of the condensate container is from about 5% to about 30%. In some embodiments, the porosity of the condensate container is about 8%.

In some embodiments, the second hydrocarbon material is produced from a condensate container disposed within the formation and gaseous hydrocarbon material is injected into the condensate container. In some embodiments, the second hydrocarbon material and at least a portion of the first hydrocarbon material are produced from the condensate container.

The injecting of the gaseous hydrocarbon material into the condensate container tends to increase the pressure within the condensate container. In some embodiments, the pressure is increased to or above the dew point pressure of the hydrocarbon material disposed within the condensate container. In some embodiments, the pressure is maintained above the dew point pressure of the hydrocarbon material disposed within the condensate container. If the pressure in the condensate container is lower than the dew point pressure of the hydrocarbon material contained in the condensate container, as the pressure in the condensate container is increased due to the injection, liquid hydrocarbon material in the condensate container vaporizes into gaseous hydrocarbon material. As the pressure is increased to the dew point pressure, the last droplet of the liquid hydrocarbon material begins vaporize. Once the pressure is increased above the dew point pressure, the hydrocarbon material in the condensate container is present in the gaseous state. In some embodiments, the dew point is determined by analyzing samples obtained from the condensate container.

In some embodiments, the pressure of the condensate container is monitored to maintain the pressure in the condensate container to be above the dew point of the hydrocarbon material in the condensate container. In some embodiments, production simulations are run to estimate when a gas to oil ratio of produced hydrocarbon material increases and the injection commences just prior to the increase in the gas to oil ratio. In some embodiments, the injection commences after hydrocarbon materials have been produced from the condensate container. In some embodiments, the injection commences after hydrocarbon materials have been produced from the condensate container from about 2 years to about 5 years. In some embodiments, the injection commences after hydrocarbon materials have been produced from the condensate container for about 5 years.

In some embodiments, the injection of the gaseous hydrocarbon material maintains the pressure in the condensate container above the dew point of the hydrocarbon material in the condensate container. In some embodiments, the pressure is maintained for at least 2 years. In some embodiments, the pressure is maintained for at least 5 years. In some embodiments, the pressure is maintained for at least 10 years. In some embodiments, the pressure is maintained for at least 20 years.

In some embodiments, the injected gaseous hydrocarbon material is injected continuously into the condensate container. In such embodiments, at least one production well disposed within the formation and in fluid communication with the condensate container is used to produce the second hydrocarbon material, which is disposed within the condensate container, and at least one injection well disposed within the formation and in fluid communication with the condensate container is used to inject gaseous hydrocarbon material into the condensate container. In some embodiments, gaseous hydrocarbon material is continuously injected into the condensate container for at least 1 month, 3 months, 6 months, 1 year, 2 years, 5 years, 10 years, or even 15 years.

In some embodiments, the injected gaseous hydrocarbon material is injected cyclically into the condensate container. For example, a "huff-and-puff" method of injecting gaseous hydrocarbon material may be used. In some embodiments, the same well may be used to produce hydrocarbon material from the condensate container and to inject gaseous hydrocarbon material into the condensate container. In some embodiments, separate wells are used for the production and injection of hydrocarbon material from the condensate container. In some embodiments, the gaseous hydrocarbon material is injected into the condensate container for 30-200 days, and then hydrocarbon material is produced from the oil container for 30-200 days. In some embodiments, the gaseous hydrocarbon material is injected into the condensate container for 100 days, and then hydrocarbon material is produced from the condensate container for 100 days. In some embodiments, the duration of each injection and production cycle increases with increased cycles of production. In some embodiments, the duration of each injection and production increases after a predetermined number of cycles. For example, during a first period, injection and production occur for 50 days each; during a second period, injection and production occur for 75 days each; during a third period, injection and production occur for 100 days each; and during a fourth period, injection and production occur for 150 days each. In some embodiments, the injection and the production is repeated. For example, the injection and the production can be repeated at least once, at least twice, at least 5 times, at least 10 times, at least 25 times, at least 50 times at least 100 times, at least 250 times, or at least 500 times.

In some embodiments, the production is suspended if the pressure in the condensate container drops below the dew point pressure of the hydrocarbon material in the condensate container.

In some embodiments, the injected gaseous hydrocarbon material is allowed to soak into the condensate container for a period before hydrocarbon material is produced from the condensate container. In some embodiments, the injected gaseous hydrocarbon material is allowed to soak into the condensate container for the same duration as the injection and production. In some embodiments, the injected gaseous hydrocarbon material is allowed to soak into the condensate container for 30-200 days. In some embodiments, the injected gaseous hydrocarbon material is allowed to soak into the condensate container for about 100 days. In some embodiments, the duration of each soak increases with increased cycles of production. For example, during a first period, soaking occurs for 50 days; during a second period, soaking occurs for 75 days; during a third period, soaking occurs for 100 days; and during a fourth period, soaking occurs for 150 days.

In some embodiments, gaseous hydrocarbon material injected into a condensate container includes a gaseous hydrocarbon material originally in place in the condensate container, and a gaseous hydrocarbon material from originally in place in a gas container. In some embodiments, the injected gaseous hydrocarbon material includes 50-80%, by volume, of gaseous hydrocarbon material produced from the gas container and 20-50%, by volume, of gaseous hydrocarbon material produced from the condensate container.

In some embodiments, gaseous hydrocarbon material is injected into a condensate container at a rate of about 10-15 MMscf/d.

In some embodiments, the injected gaseous hydrocarbon material is injected into an oil container. Initially, hydrocarbon material is present in the oil container in the liquid state. The difference in pressure between the oil container and the surface tends to drive the hydrocarbon material from the oil container to the surface. As hydrocarbon material is produced from the oil container, pressure within the oil container decreases. Decreases in the pressure within the oil container reduces the driving force, which may decrease the production rate of oil from the oil container. In some embodiments, as the pressure decreases, gases dissolved in the hydrocarbon material comes out of solution, the expansion of the gas helps to offset the reduction in pressure due to the production of the hydrocarbon material from the oil container. For example, the hydrocarbon material can be produced by solution gas drive, gas cap drive, or both.

The injecting of the gaseous hydrocarbon material into the oil container tends to increase the pressure within the oil container. In some embodiments, the increased pressure tends to increase the driving force producing the second hydrocarbon material from the oil container. In some embodiments, the injection of the gaseous hydrocarbon material increases the pressure in the oil container to at or above the bubble point pressure. In some embodiments, gaseous hydrocarbon material is injected into the oil container at an injection well and produced from the oil container at a production well. In some embodiments, the production well is adjacent the injection well. In some embodiments, the injection of gaseous hydrocarbon into the oil container provides a pressure differential driving the hydrocarbon material in the oil container toward the production well.

In some embodiments, the injection of the gaseous hydrocarbon material maintains the pressure in the condensate container above the bubble point. In some embodiments, the pressure is maintained for at least 2 years. In some embodiments, the pressure is maintained for at least 5 years. In some embodiments, the pressure is maintained for at least 10 years. In some embodiments, the pressure is maintained for at least 20 years.

In some embodiments, the injected gaseous hydrocarbon material and the liquid hydrocarbon material have different permeabilities in the oil container. In some embodiments, due to the relative permeability of the liquid and gaseous hydrocarbon materials, the injected gaseous hydrocarbon material may displace the liquid hydrocarbon material from pores of the oil container. In some embodiments, the injected gaseous hydrocarbon material penetrates into the low permeability matrix due to diffusion of gaseous hydrocarbon material into liquid hydrocarbon material. The diffusion of gaseous hydrocarbon material into the liquid hydrocarbon material is driven by a concentration difference.

In some embodiments, the injected gaseous hydrocarbon material is at least partially miscible in the liquid hydrocarbon material disposed within the oil container. The miscibility of the injected gaseous hydrocarbon material in the liquid hydrocarbon material in the oil disposed in the oil container may depend on the composition of the injected gaseous hydrocarbon material, the pressure in the oil container, or both. In some embodiments, from about 10% to 100%, by volume, of the injected gaseous hydrocarbon material is miscible in the liquid hydrocarbon material disposed within the oil container. Miscibility may increase the recovery of the liquid hydrocarbon material. Without wishing to be bound by theory, it is believed that at least a portion of the injected gaseous hydrocarbon dissolves in the liquid hydrocarbon material, which can cause oil swelling, a decrease in viscosity, a decrease in density, or a combination thereof, and effect an increase in the production of the liquid hydrocarbon material.

Similarly, in some embodiments, the injected gaseous hydrocarbon material diffuses into the liquid hydrocarbon material disposed within the oil container. The diffusion of the injected gaseous hydrocarbon material in the liquid hydrocarbon material in the oil disposed in the oil container may depend on the composition of the injected gaseous hydrocarbon material, the concentration of the gaseous hydrocarbon material, the concentration of the liquid hydrocarbon material, or a combination thereof. Diffusion allows the injected gaseous hydrocarbon material to penetrate into the liquid hydrocarbon material disposed within the low permeability matrix. This can increase the pressure in the oil container and displaces the liquid hydrocarbon material stored in the matrix, where recoveries are enhanced.

In some embodiments, the injection of gaseous hydrocarbon material into the oil container decreases the viscosity of the liquid hydrocarbon material disposed within the oil container. By decreasing the viscosity, the production rates of the liquid hydrocarbon material may be increased. In some embodiments, the injection of gaseous hydrocarbon material into the oil container decreases the viscosity of the liquid hydrocarbon material at least 10%, at least 20%, at least 30%, at least 40%, or at least 50% as compared to the initial viscosity of the liquid hydrocarbon material.

In some embodiments, the initial pressure within the oil container is from about 2000 psi to about 15000 psi. In some embodiments, the initial pressure within the oil container is from about 3000 psi to about 8000 psi. In some embodiments, the initial pressure within the oil container is about 6000 psi.

In some embodiments, the bubble point pressure within the oil container is about 100 psi to about 15000 psi. In some embodiments, the bubble point pressure within the oil container is from about 150 psi to about 8000 psi. In some embodiments, the bubble point pressure within the oil container is from about 300 psi to about 6000 psi.

In some embodiments, for example, in shale formations, the matrix permeability of the oil container is from about 0.001 millidarcys to about 0.1 millidarcys. In some embodiments, for example, in shale formations, the matrix permeability of the container is about 487 nanodarcys. In some embodiments, oil container includes naturally occurring fractures, hydraulically-effected fractures, or a combination thereof. In some embodiments, the fracture permeability of the oil container is about 0.04 millidarcys.

In some embodiments, for example, in tight formations, gaseous hydrocarbon material is injected into a gas-oil container. In some embodiments, the matrix permeability of the gas-oil container is from about 0.1 millidarcys to about 10 millidarcys.

In some embodiments, the matrix porosity of the oil container is from about 3% to about 30%. In some embodiments, the matrix porosity of the oil container is from about 5% to about 30%. In some embodiments, the matrix porosity of the oil container is about 8%. In some embodiments, the fracture porosity of the oil container is about 0.08%.

In some embodiments, the injected gaseous hydrocarbon material comprises at least one hydrocarbon. In some embodiments, the injected gaseous hydrocarbon material comprises: 70-100 vol % methane; 5-20 vol % ethane; 5-20% propane; and 0-10 vol % hexane, based on total volume of the injected gaseous hydrocarbon material. In some embodiments, the injected gaseous hydrocarbon material is methane. In some embodiments, the injected gaseous hydrocarbon material comprises: 70 vol % methane; 20 vol % propane; and 10% hexane, based on total volume of the injected gaseous hydrocarbon material.

In some embodiments, the injected gaseous hydrocarbon material is injected continuously into the oil container. In such embodiments, at least one production well disposed within the formation and in fluid communication with the oil container is used to produce hydrocarbon material disposed within the oil container, and at least one injection well disposed within the formation and in fluid communication with the oil container is used to inject gaseous hydrocarbon material into the oil container. In some embodiments, gaseous hydrocarbon material is injected continuously into the oil container for at least 1 month, at least 3 months, at least 6 months, at least 1 year, at least 2 years, at least 5 years, at least 10 years, or at least 15 years.

In some embodiments, the injected gaseous hydrocarbon material is injected cyclically into the oil container. For example, a "huff-and-puff" method of injecting gaseous hydrocarbon material is employed. In some embodiments, the same well may be used to produce hydrocarbon material from the oil container and to inject gaseous hydrocarbon material into the oil container. In some embodiments, separate wells are used for the production hydrocarbon material and injection of gaseous hydrocarbon material from the condensate container. In some embodiments, the gaseous hydrocarbon material is injected into the oil container for 30-200 days, and then hydrocarbon material is produced from the oil container for 30-200 days. In some embodiments, the gaseous hydrocarbon material is injected into the oil container for 100 days, and then hydrocarbon material is produced from the oil container for 100 days. In some embodiments, the duration of each injection and production increases with increased cycles of production. In some embodiments, the duration of each injection and production increases after a predetermined number of cycles. For example, during a first period, injection and production occur for 50 days each; during a second period, injection and production occur for 75 days each; during a third period, injection and production occur for 100 days each; and during a fourth period, injection and production occur for 150 days each. In some embodiments, the injection and the production is repeated. For example, the injection and the production can be repeated at least once, at least twice, at least 5 times, at least 10 times, at least 25 times, at least 50 times at least 100 times, at least 250 times, or at least 500 times.

In some embodiments, the production is suspended if the pressure in the oil container drops below the bubble point pressure of the hydrocarbon material in the oil container.

In some embodiments, the injected gaseous hydrocarbon material is allowed to soak into the oil container for 30-200 days. In some embodiments, the injected gaseous hydrocarbon material is allowed to soak into the oil container for about 100 days. In some embodiments, the duration of each soak increases with increased cycles of production. For example, during a first period, soaking occurs for 50 days; during a second period, soaking occurs for 75 days; during a third period, soaking occurs for 100 days; and during a fourth period, soaking occurs for 150 days.

In some embodiments, gaseous hydrocarbon material injected into an oil container includes a gaseous hydrocarbon material originally in place in a condensate container, and a gaseous hydrocarbon material from originally in place in a gas container. In some embodiments, the injected gaseous hydrocarbon material includes 50-100%, by volume, of gaseous hydrocarbon material produced from the gas container and 0-50%, by volume, of gaseous hydrocarbon material produced from the condensate container.

In some embodiments, the injected gaseous hydrocarbon material is injected into an oil container at a rate of about 2 MMscf/d to about 10 MMscf/d. In some embodiments, the injected gaseous hydrocarbon material is injected into an oil container at a rate of about 5 MMscf/d.

In some embodiments, the injection of the gaseous hydrocarbon material begins shortly after the production of the first hydrocarbon material from the formation. For example, once the gas-rich stream is separated from hydrocarbon material produced from a condensate container, and/or once gaseous hydrocarbon material is produced from a gas container, it can be injected into the condensate container or an oil container. In other embodiments, the injection of the gaseous hydrocarbon material occurs after the production of hydrocarbon material has begun. For example, the injection of the gaseous hydrocarbon may commence up to five years after production of the first hydrocarbon material has begun; or from two to five years, about two years, about three years, about four years, or about five years, after the production of the first hydrocarbon material has begun.

In some embodiments, a pump, such as a downhole pump or a surface pump, is used to provide additional pressure differential to produce hydrocarbon material to the surface. In some embodiments, a downhole pump provides artificial lift for liquid hydrocarbon material disposed within an oil formation. In some embodiments, pumps and/or compressors can be used to control the bottomhole pressure during production. For example, the bottom hole pressure can be lowered to increase the pressure differential between the bulk container and the bottom hole pressure, thereby increasing the production rate.

In some embodiments, the formation is has very low matrix permeability. In some embodiments, the permeability of the formation may be increased, for example, by effecting hydraulic fracturing in the formation. In some embodiments, the effecting of the hydraulic fracturing is in a gas container, a condensate container, an oil container, or any combination thereof to increase the permeability of the container and to increase production of hydrocarbon material from the container.

In another aspect, a method of producing hydrocarbon material from a formation is provided. Gaseous hydrocarbon material is produced from the first container. At least a portion of the produced gaseous hydrocarbon material is injected into the second container. Hydrocarbon material is produced from the second container.

In some embodiments, the first container is a gas container. In some embodiments, the second container is a condensate container or an oil container.

In some embodiments, the produced gaseous hydrocarbon material is originally in place in the first container prior to any production from the formation.

In some embodiments, the first container and the second container are identified prior to the production from the first container.

In one aspect, a method of producing hydrocarbon material from a formation is provided. A gaseous hydrocarbon material is injected into a container disposed within the formation. A hydrocarbon material is then produced from the container.

In some embodiments, the container is an oil container. In some embodiments, the container is a condensate container.

In some embodiments, the injected gaseous hydrocarbon material includes gaseous hydrocarbon material originally in place in the formation.

EXAMPLES

Example 1: Injection of Gaseous Hydrocarbon Material into a Condensate Container A condensate container of the formation has been simulated with the use of a single porosity compositional simulator. An average permeability in the order of 0.07 and was used in the simulation. The compositional components are from the Duvernay shale in Canada (Taylor et al., 2014). The wells are horizontal and are hydraulically fractured.

Reservoir Model Description and PVT Data

The single porosity condensate reservoir model consists of 67×50×15=50250 grid blocks and each grid block size is 30 m×30 m×2.0 m. Production comes from 2 identical horizontal wells. Production wells are perforated in layer 12 while injection wells are perforated in layers 1 to 9. The reservoir model is compositional and includes components from the Duvernay shale in Canada (Taylor et al., 2014). The reservoir model is run using GEM of the Computer Modeling Group (CMG®). Fluid PVT was generated using CMG's Winprop.

Assumptions

The single porosity compositional simulation work includes the following key assumptions:

1. The near-well phase equilibrium and fluid flow interactions are accurately represented using a fine corner grid with fluid properties calculated from an equation of state (EOS) model.
2. Production constraints: Maximum surface gas production rate and minimum bottomhole pressure. If a producer is not able to meet the surface production rate, the gas rate is reduced to meet the minimum bottomhole pressure.
3. Cumulative recovery factors are compared after 10 years of production.
4. There is no aquifer support.

Condensate Bank

The formation of condensate banks along hydraulic fractures is of common occurrence in shale reservoirs once pressure goes below the dew point. An example is presented in FIGS. 3A-C where the oil saturations increase from zero (top graph) to 40% (bottom graph) around the horizontal wellbore and in one transverse hydraulic fracture under natural depletion.

Figure 3A:
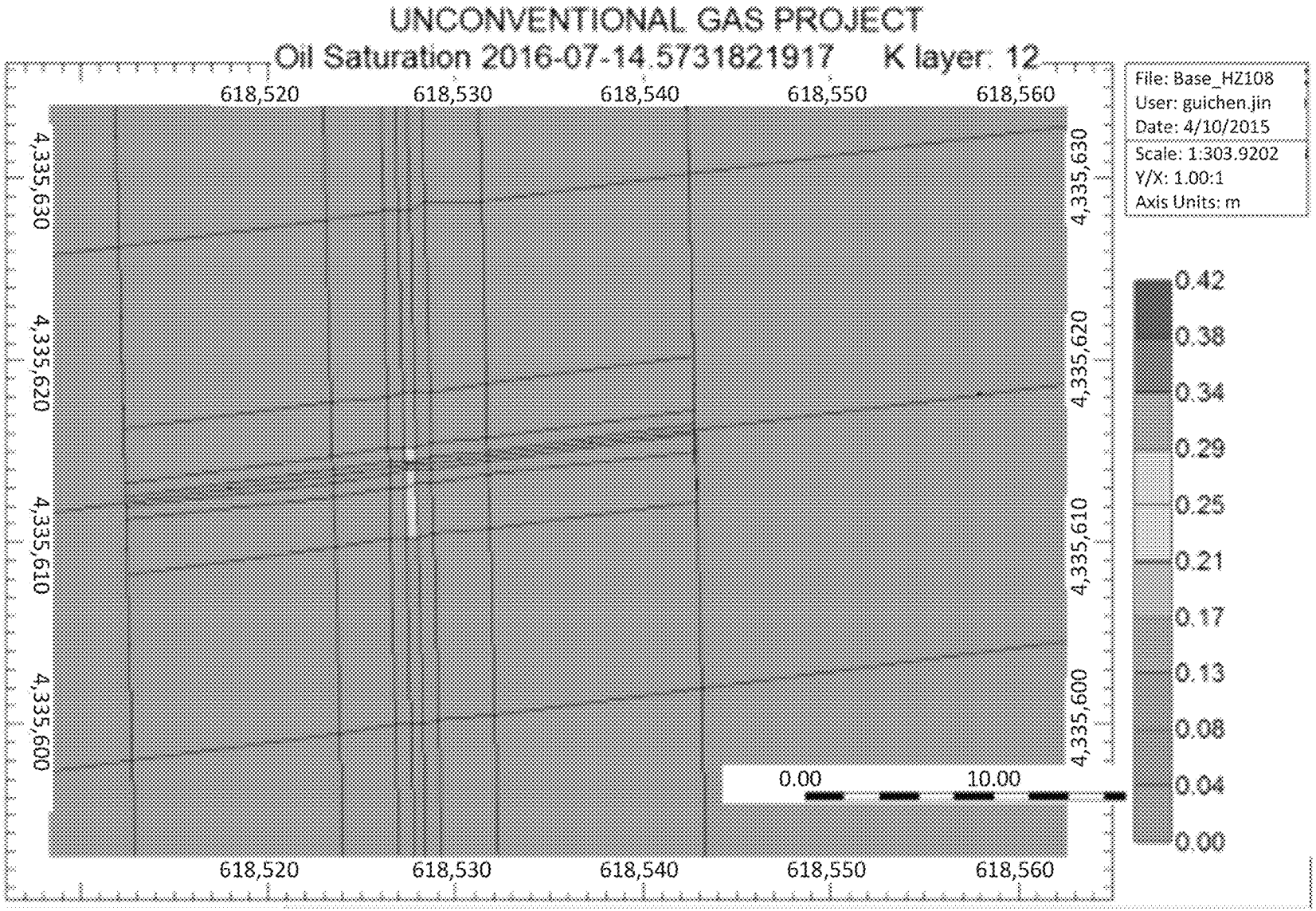
FIG. 3A provides a diagram showing the oil concentration in a condensate container according to an embodiment of the invention.
Figure 3B:
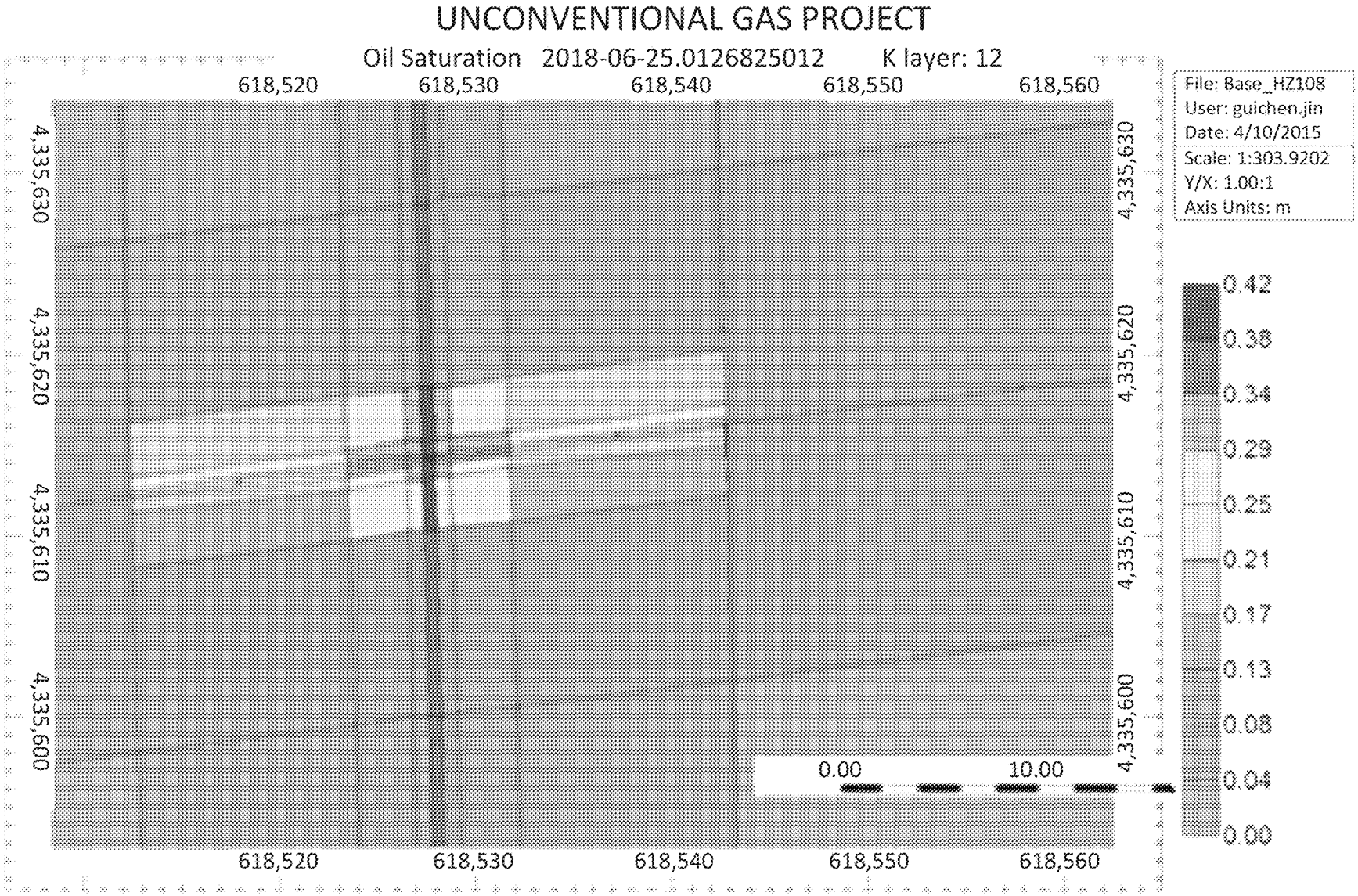
FIG. 3B provides a diagram showing the oil concentration in the condensate container of FIG. 3A after approximately 2 years of production with no gas injection.
Figure 3C:
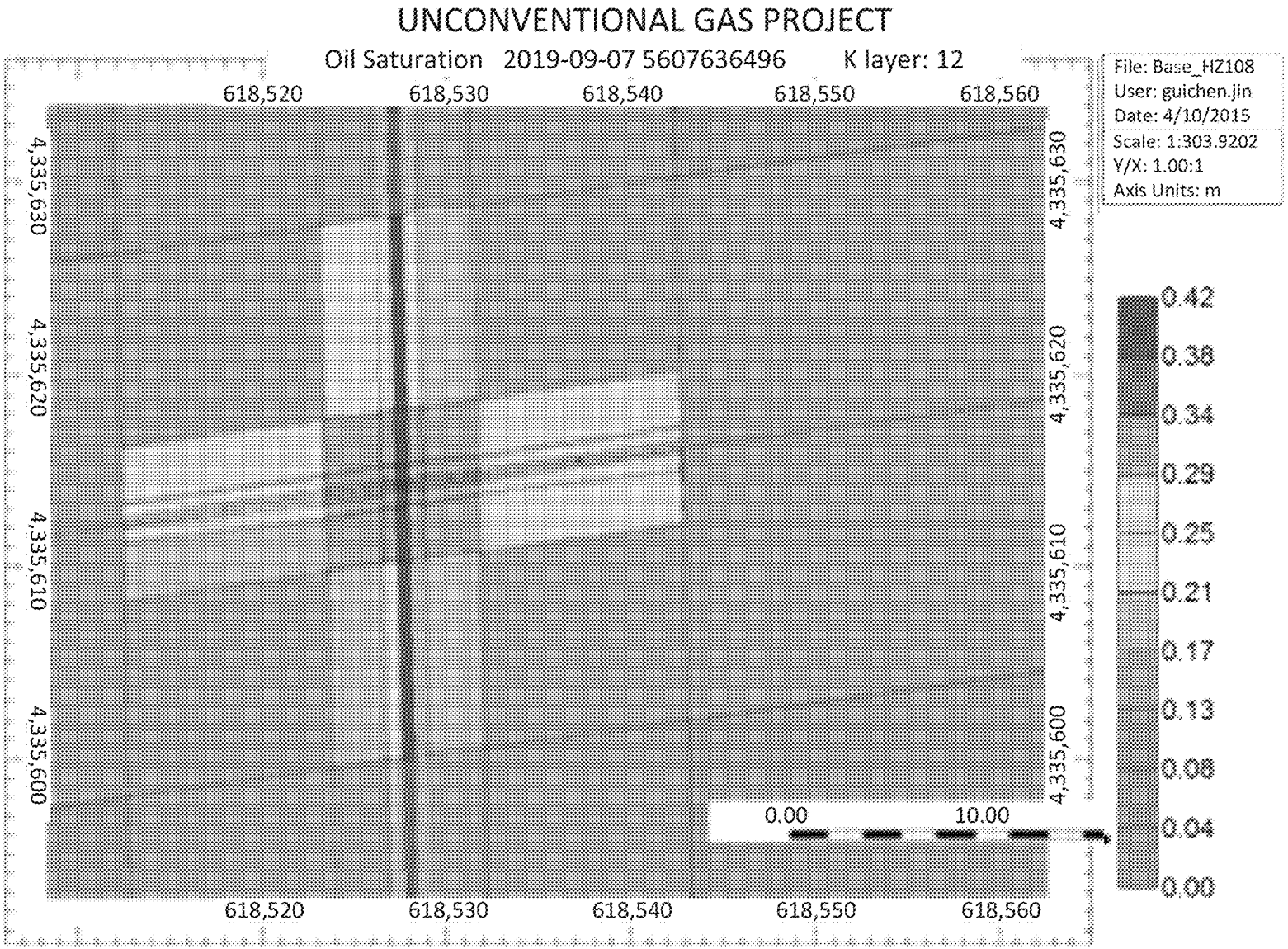
FIG. 3C provides a diagram showing the oil concentration in the condensate container of FIG. 3A after approximately 3 years of production with no gas injection.

The FIG. 3A is captured at an assumed date of July 2016; FIG. 3B in June 2018 and FIG. 3C September 2019. In the simulations presented in FIGS. 3A-3B, production began in July 2014. The liquid bank forming around the wellbore and the hydraulic fracture reduces gas deliverability. Thus a strategy to increase gas deliverability in a situation like this would be to inject gas (or other suitable fluid) with a view to maintaining the reservoir pressure above the dew point as long as possible during production for postponing liquid dropout, or if this is already occurring, to re-evaporate the condensate around the wellbore and hydraulic fractures.

Recycling Gas from Condensate

More than 40 scenarios were run with the single porosity model to investigate the possibility of gas injection and scenarios 41, 42 and 43 are discussed herein. In these scenarios, two vertical wells inject dry gas stripped from recycling operations at the surface and dry gas from a deeper part of the formation (e.g. from a gas container). The injection wells are perforated in upper layers 1 to 9 and hydraulically fractured in layers 7 to 9. Non-Darcy flow is assigned in the hydraulic fractures. The injected gas is continuously injected into the formation.

Figure 4:
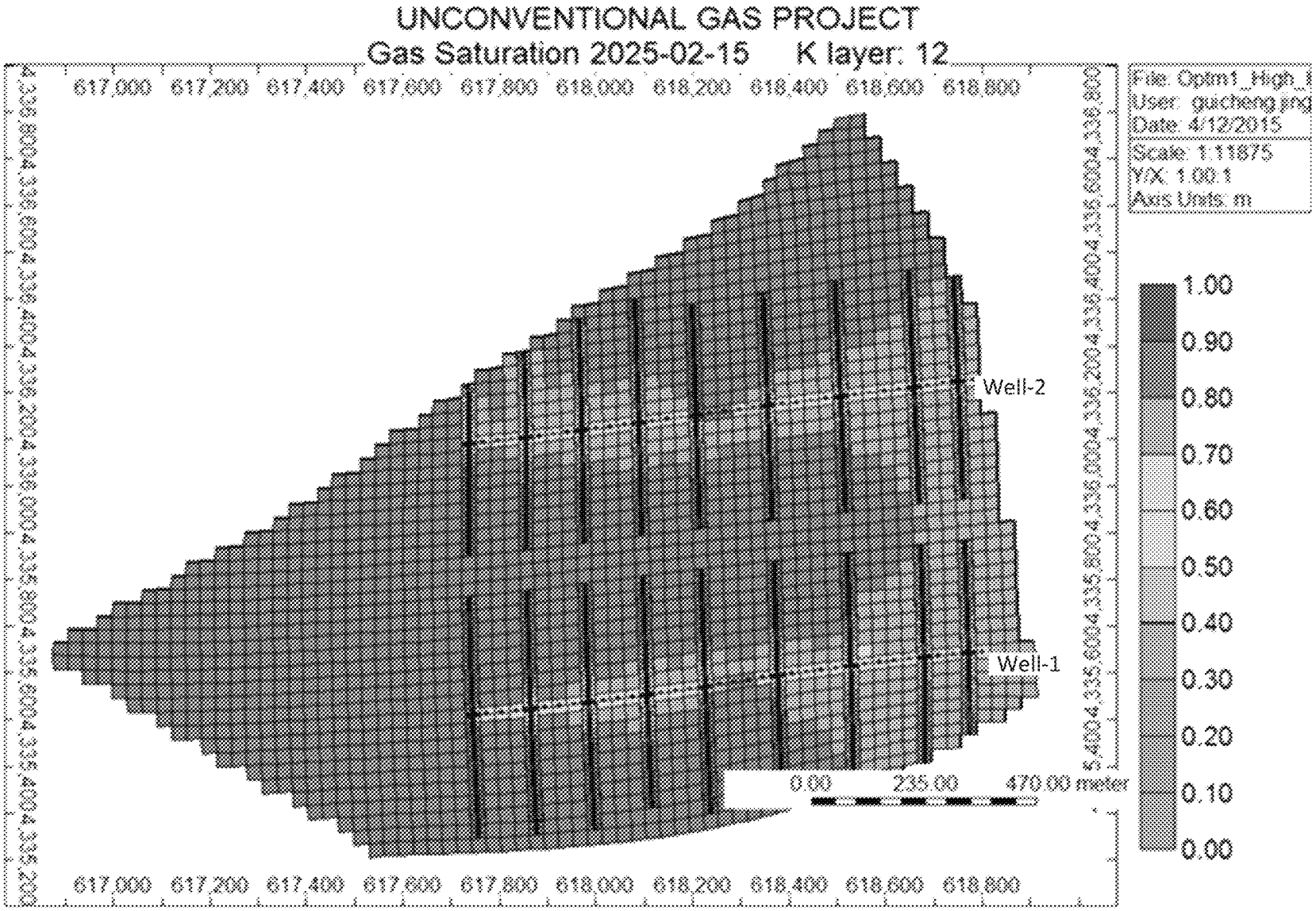
FIG. 4 provides a diagram showing gas saturation after 10 years of production and gas injection.

Several combinations of horizontal lengths, fracturing stages and half-length of hydraulic fractures were considered in efforts to obtain the combination that leads to maximum recovery factors after 10 years of production. Well locations are shown in the map view of FIG. 4 that also includes gas saturation after 10 years of production and gas injection (scenario 41). The horizontal wellbores are 1080 m long, there are 9 fracturing stages in each well, 240 m fracture half-length, and injection of both recycling and supplemental dry gas. Scenario 42 is the same but includes 12 fracturing stages. Scenario 43 is the same as 42 but adds a shorter production horizontal well in the western part of the structure and a third vertical injection well to drain more efficiently stranded gas stored in that region.

In scenario 41 the gas and oil recovery factors are 23.2% and 21.9%, respectively. In Scenario 42 the gas and oil recovery factors are 27.6% and 25.7%. In scenario 43 the gas recovery and oil recovery factors amount to 29.7% and 26.9%. Recovery without gas injection was in the order of 19%.

Example 2: Injection of Gaseous Hydrocarbon Material into an Oil Container

The upper part of the Eagle Ford structure considered in this study stores oil. Production from this container has been relatively small as efforts have concentrated on production from the condensate container. Recovery factors from an oil container are small. Simulations were run to examine the possibility of increasing recoveries from an oil container by gas injection.

Simulation Model

In Example 2, a model of a shale oil reservoir was built using a compositional simulator (GEM, CMG). Data were gathered from the Eagle Ford shale literature. The oil composition was simplified to pseudo-components in order to reduce simulation times (Table 1).

TABLE 1

Initial molar composition of the reservoir fluid

| Component | Mol |
|---|---|
| $CO_2$ | 0.91% |
| $N_2$ | 0.16% |
| C1 | 36.47% |
| C2 | 9.67% |
| C3 | 6.95% |
| C4 to C6 | 12.55% |
| $C7+_1$ | 20% |
| $C7+_2$ | 10% |
| $C7+_3$ | 3.29% |
| Total | 100% |

Figure 5:
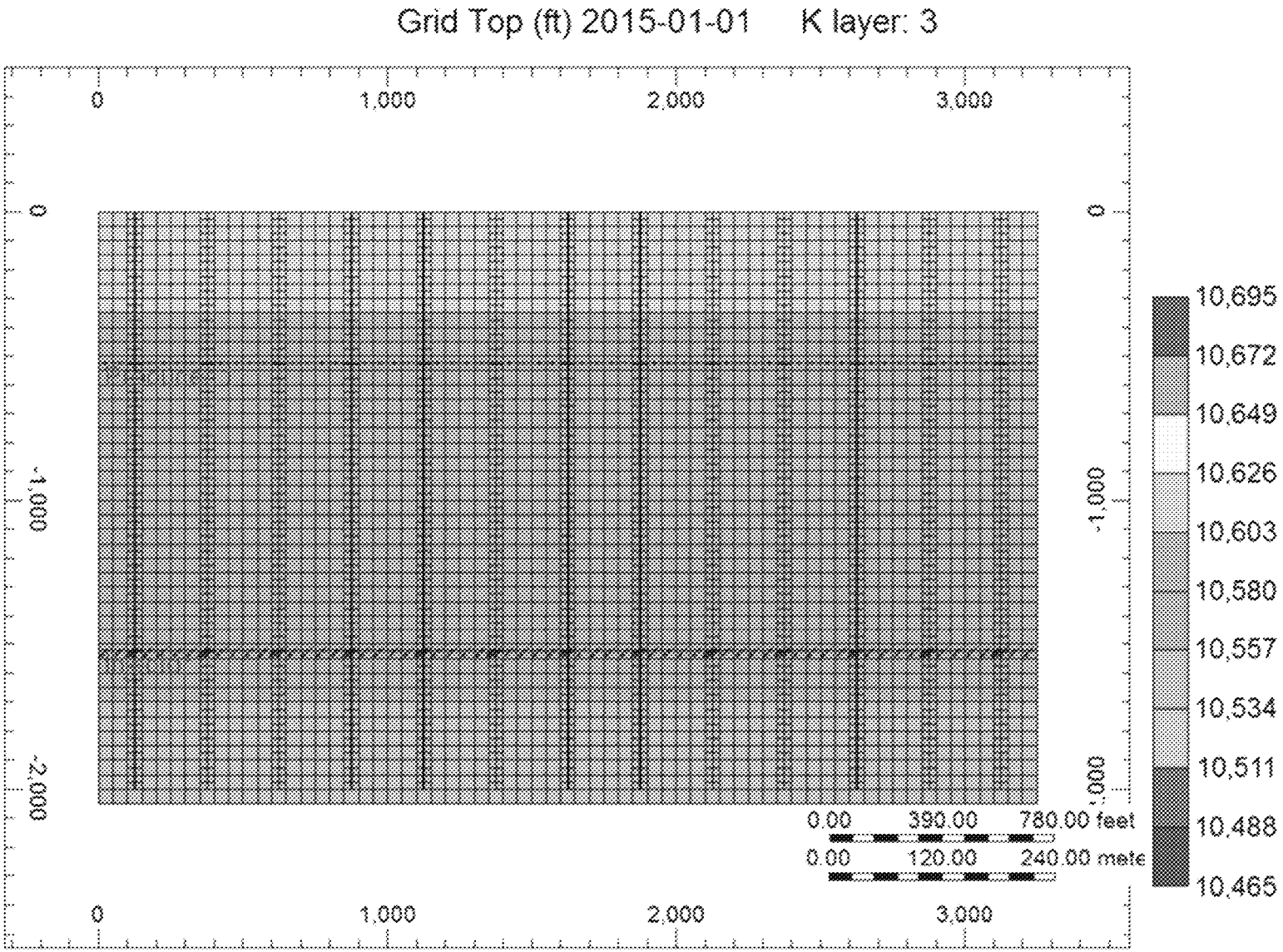
FIG. 5 provides a diagram showing a simulation model used in the modeling of gas injection into an oil container according to an embodiment of the invention.

The simulation model (FIG. 5) utilizes a Cartesian grid with an area of 153 acres divided into 65*41 grid cells, and a thickness of 200 ft divided into 5 layers. Single porosity, dual porosity and dual permeability models were used and compared in this study. The matrix permeability is 250 nanodarcys and the matrix porosity is 8%; the reservoir has a dip angle of 2°. In the dual porosity and the dual permeability models, the fracture permeability if 0.04 millidarcys and the fracture spacing is 10 ft. All these properties are taken as constant throughout the simulation model (in this sense the reservoir properties are homogeneous). Table 2 summarizes the reservoir properties.

TABLE 2

Reservoir Properties.

| | |
|---|---|
| Matrix Porosity, $\phi_m$ (%) | 8 |
| Matrix Permeability, $K_m$ (mD) | 0.00025 |
| Fracture Porosity $\phi_2$ (%) | 0.08 |
| Fracture Permeability $K_2$ (mD) | 0.04 |
| Fracture Spacing hm (ft) | 10 |
| Thickness, h (ft) | 200 |
| Formation Top, H (ft) | 10500 |
| Matrix Compressibility, $c_m$ (1/psi) | $1*10^{-6}$ |
| Fracture Compressibility, $c_f$ (1/psi) | $1*10^{-5}$ |
| Dip Angle | 2° |
| Initial Pressure, $P_i$ (psi) | 6000 |

Figure 6A:
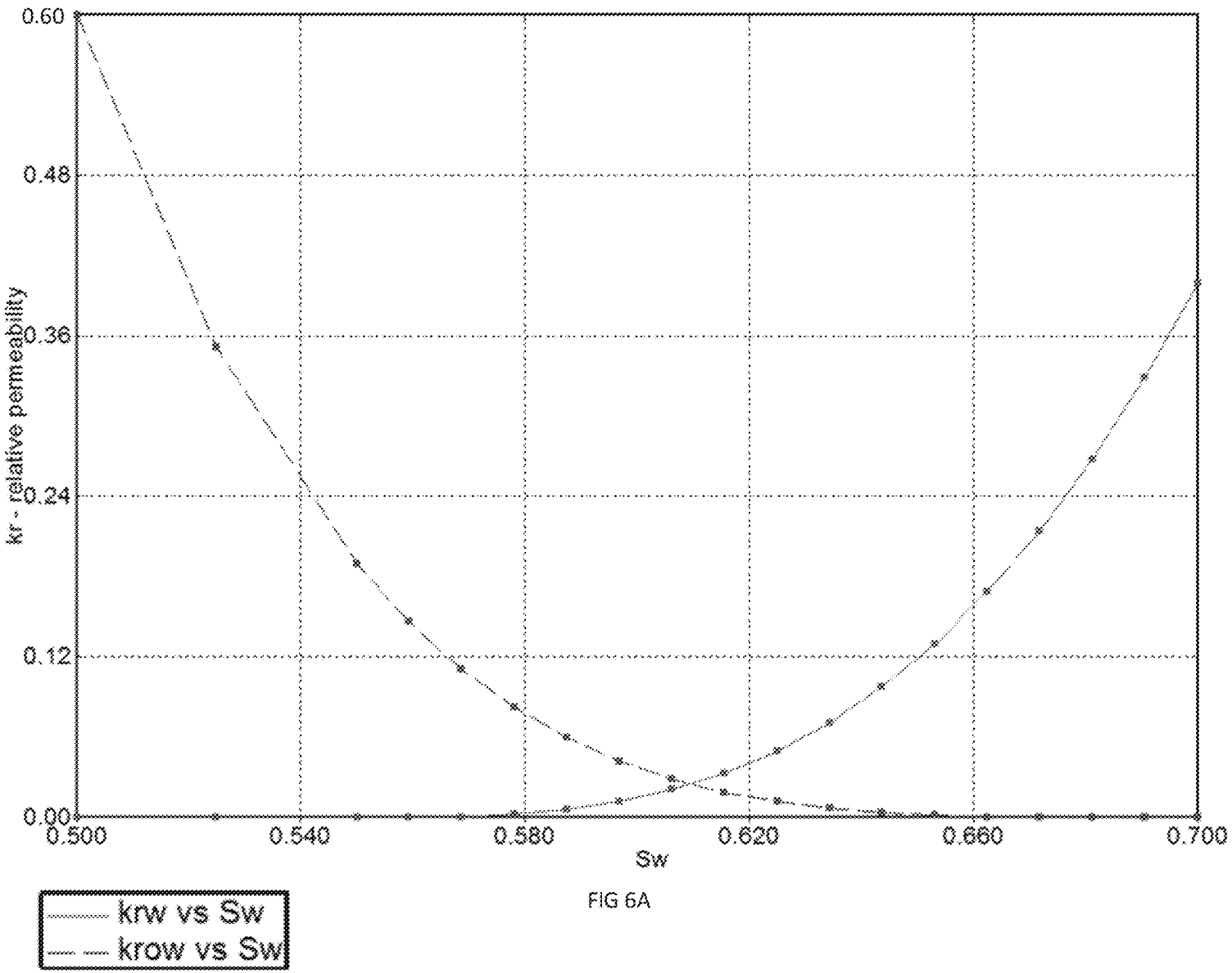
FIG. 6A provides a chart showing the relative permeability of water and oil in a formation according to an embodiment of the invention.
Figure 6B:
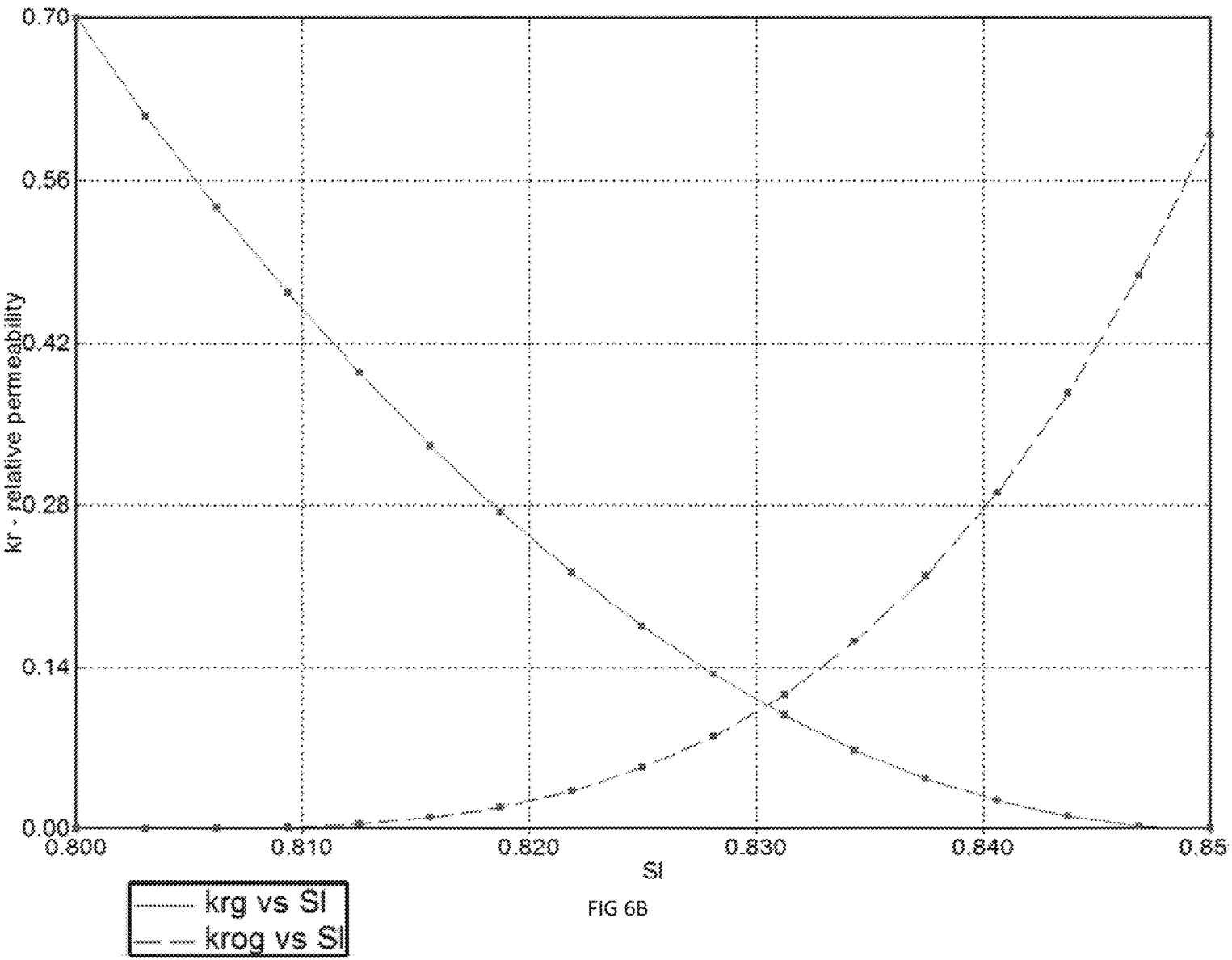
FIG. 6B provides a chart showing the relative permeability of gas and oil in the formation according to the embodiment of FIG. 6A.
Figure 6C:
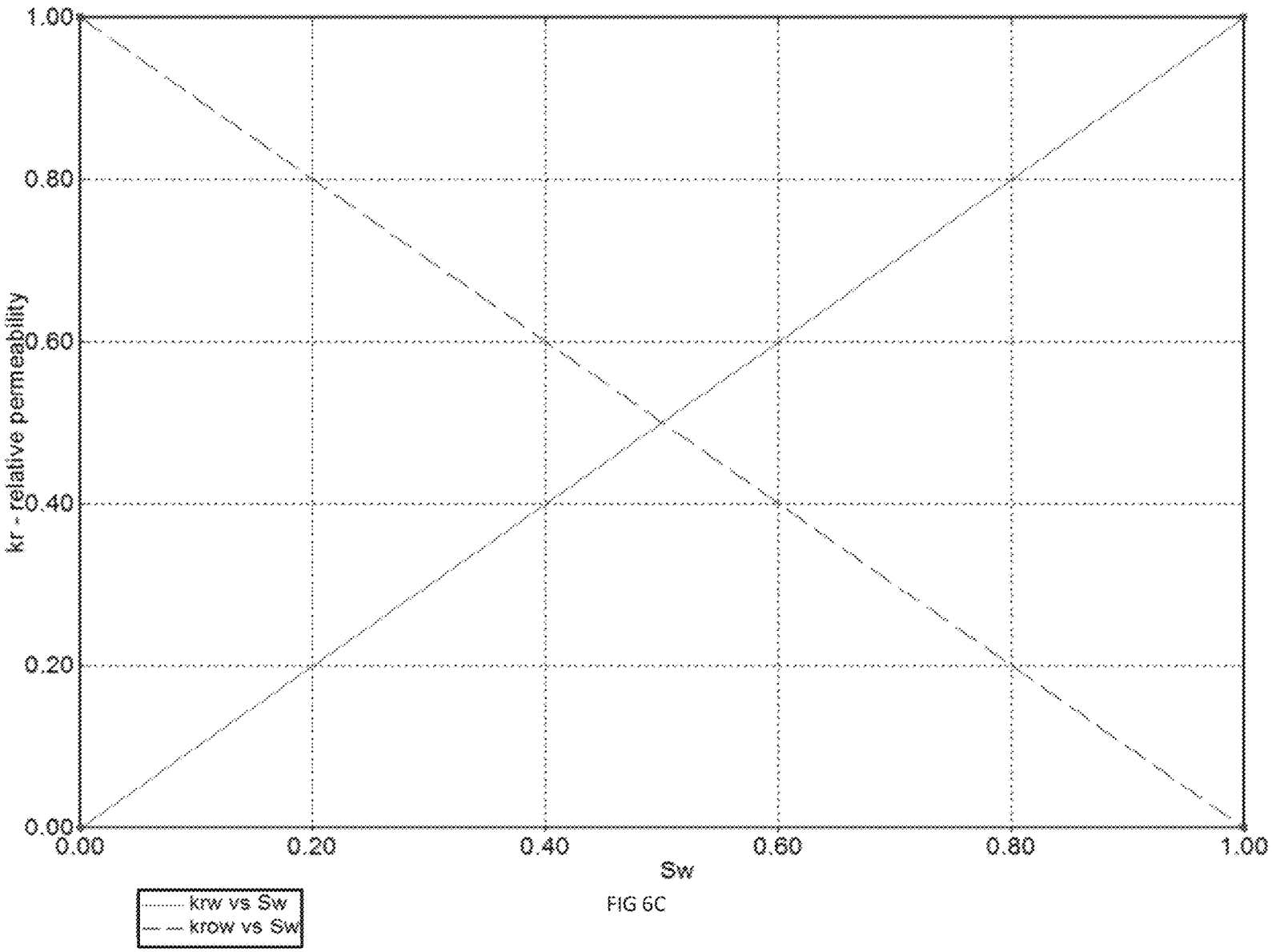
FIG. 6C provides a chart showing the relative permeability of water and oil in a formation according to an embodiment of the invention.
Figure 6D:
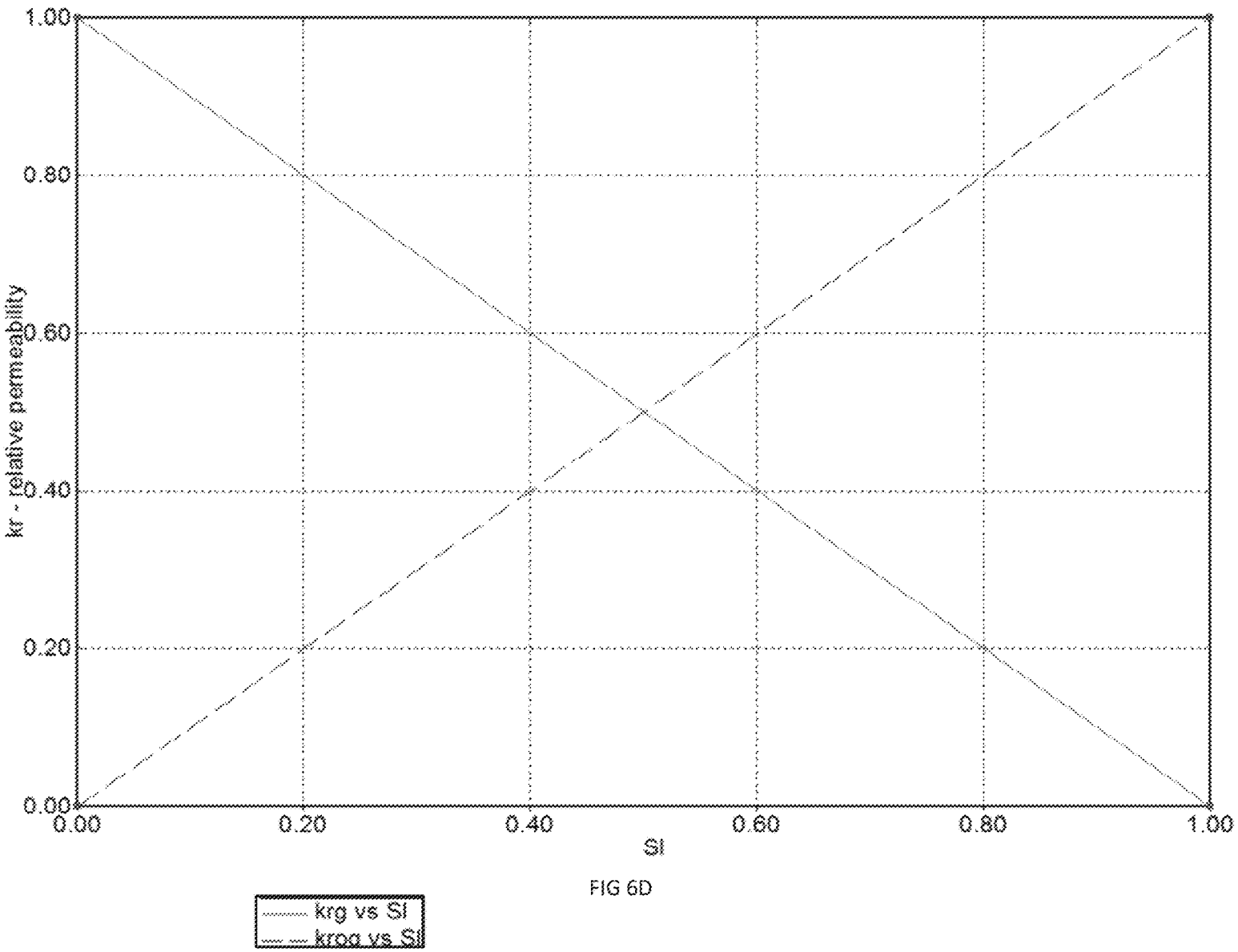
FIG. 6D provides a chart showing the relative permeability curves of gas and oil in the formation according to the embodiment of FIG. 6C.

Relative permeability curves for the matrix system were built using the data published by Honarpour et al. (2012) for calcite rich regions in shale reservoirs. For the fracture system, straight line relative permeabilities were adopted. FIGS. 6A and 6B shows the relative permeability curves in the single porosity model. FIGS. 6C and 6D shows the relative permeability curves in the dual permeability and dual porosity models.

The Example takes into account molecular diffusion as mass transport mechanism. Sigmund correlation is used to calculate gas phase and oil phase diffusion coefficients.

Two horizontal wells, one injector and one producer, were drilled in the third layer of the model, the injector is updip of the producer. The horizontal length of the wells is 3250 ft; multistage hydraulically fracturing stimulation was applied to both wells, the number of stages is 13, the hydraulic fractures half-length is 500 ft in the producer and 450 ft in the injector, the fracture width is 0.01 ft and the fracture (hydraulic) permeability is 1000 millidarcys in both wells. In the production well, the minimum allowed bottom hole pressure was set at 2000 psi, while in the injection well the bottom hole pressure was restricted to a maximum of 5000 psi.

Figure 7:
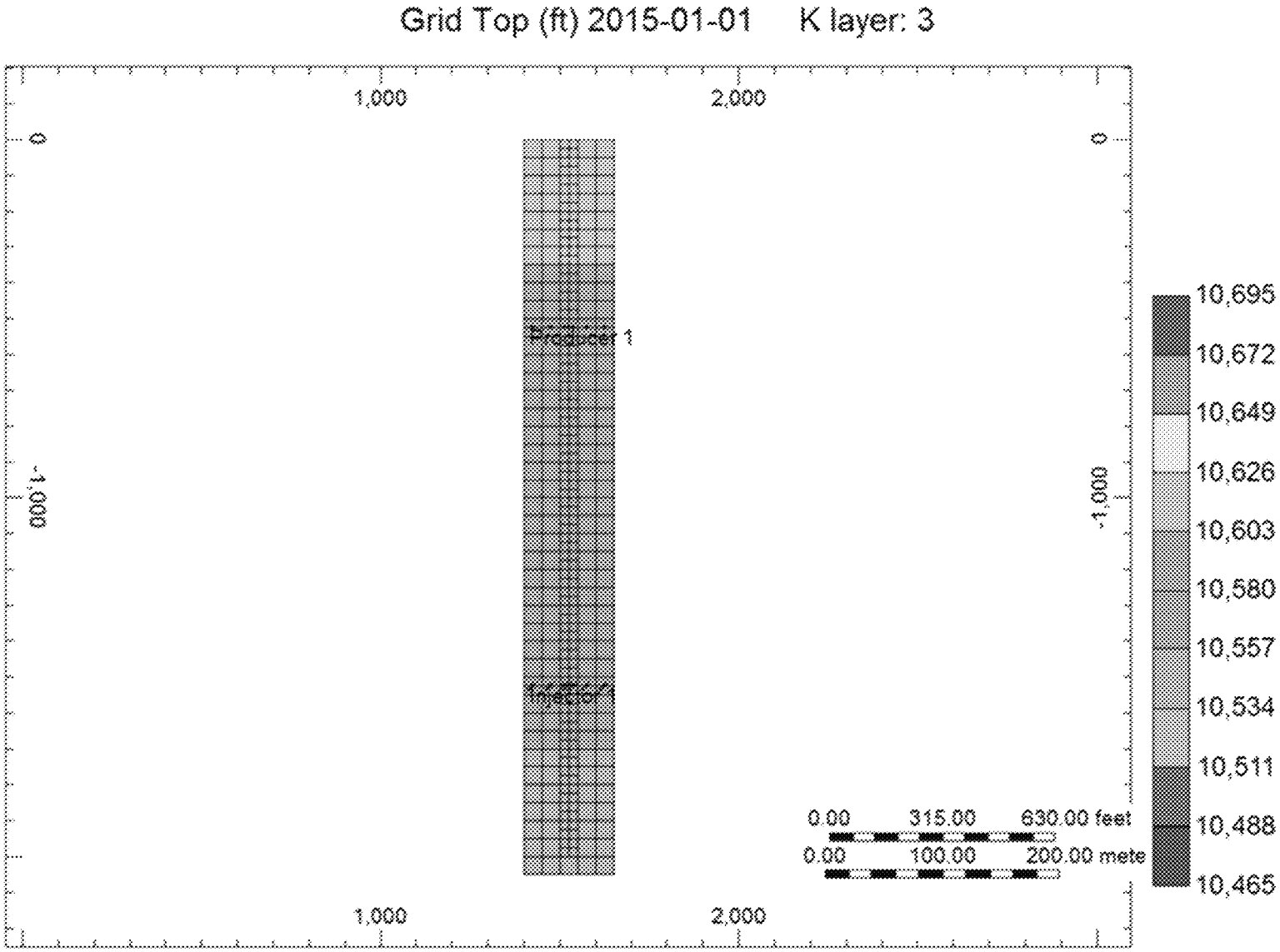
FIG. 7 provides a diagram showing a simulation model used in the modeling of gas injection into an oil container according to an embodiment of the invention.

In order to reduce simulation times, a submodel of 5×41×5 grid cells with only one hydraulic fracture was constructed. FIG. 7 presents the submodel.

Two injection techniques were considered: continuous gas injection and huff and puff gas injection. The cyclic huff and puff process is an improved oil recovery method applied in heavy oil reservoirs in which a horizontal well is used for both injection and production. The possibility of extending this method to gas injection in shale reservoirs has been proposed by Wan et al. (2013a). In this example, cyclic huff and puff gas injection was studied for the Eagle Ford Shale. Each cycle consists in 100 days of injection followed by 100 days of production.

Single Porosity Model

The sweet spots of the Eagle Ford shale are often naturally fractured. However, a single porosity simulation model is used as a starting point to determine feasibility of gas injection in those areas where only matrix porosity is present. The model is used for simulating an oil container of the Eagle Ford oil shale. A sensitivity analysis to the matrix permeability was performed with a view to evaluate the effect of this property on gas injection performance. Four cases with different values of permeability were simulated: 250 nanodarcys, 0.001 millidarcys, 0.005 millidarcys and 0.01 millidarcys. Two injection fluids were considered; the first fluid composition is 100% methane and the second is 70% C1, 20% C3 and 10% C6; the second composition was suggested by Wan et al. (2015).

Injection starts after 5 years of production. Table 3 summarizes the results of the sensitivity analysis. It shows that for a matrix permeability of 250 nanodarcys, oil recovery is not improved with injection of any of the two fluids; injected gas can barely penetrate the matrix due to the very low permeability. A similar result is obtained when matrix permeability is 0.001 millidarcys; the increment in oil recovery by gas injection is not significant.

TABLE 3

Oil recovery factors obtained for different matrix permeabilities

| Matrix Permeability | Primary Recovery (%) | Recovery by CH4 injection (%) | Recovery by (70% C1 + 20% C3 + 10% C6) injection (%) |
|---|---|---|---|
| 250 nd | 5.25 | 5.25 | 5.25 |
| 0.001 md | 7.04 | 7.28 | 7.72 |
| 0.005 md | 8.94 | 10.72 | 13.55 |
| 0.01 md | 9.39 | 13.21 | 16.80 |

A matrix permeability of 0.005 millidarcys allows the injected gas (70% C1+20% C3+10% C6) to flow into the matrix and increase oil recovery. For methane injection, the increment becomes important when matrix permeability is 0.01 millidarcys. Subsequent single porosity simulations use a 0.01 millidarcys matrix permeability. It is found that the shale oil reservoir performance under gas injection is strongly affected by matrix permeability when using single porosity models. However, the permeability values that allow increasing oil recoveries in these cases depend on the reservoir fluids composition, the injected fluid composition, the injection pressure and the injection rate. Therefore the threshold permeability must be determined for each particular injection project.

Figure 8A:
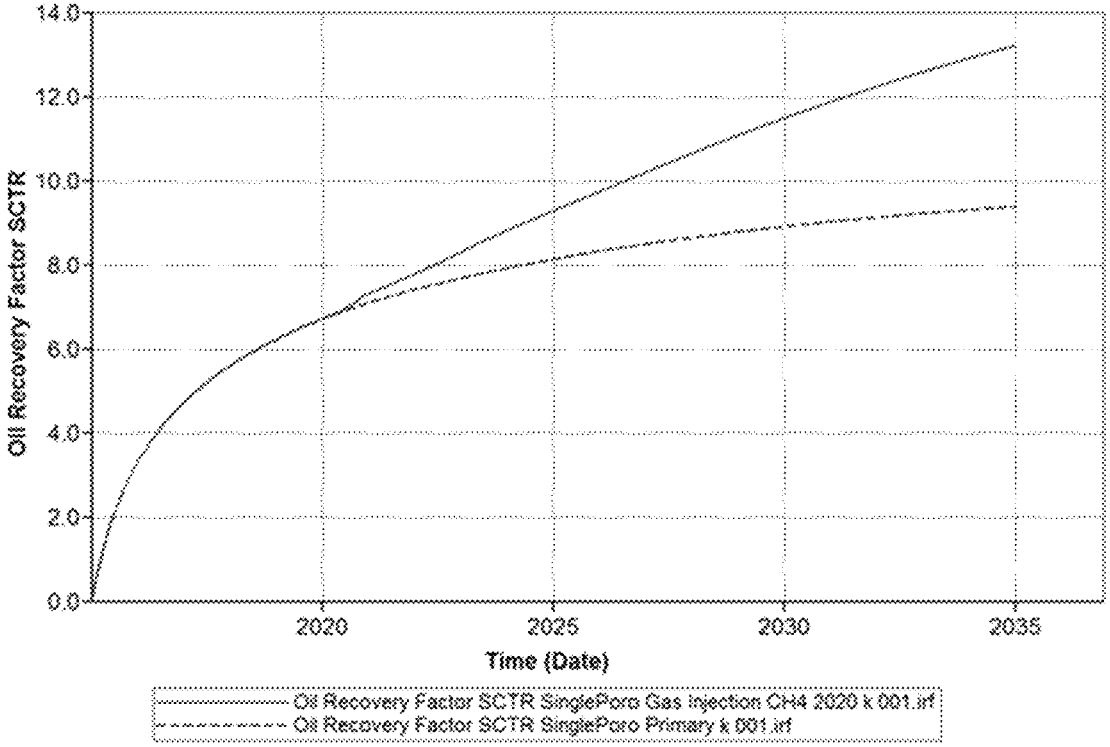
FIG. 8A provides a chart showing the comparative oil recovery with primary production and methane injection according to an embodiment of the invention.
Figure 8B:
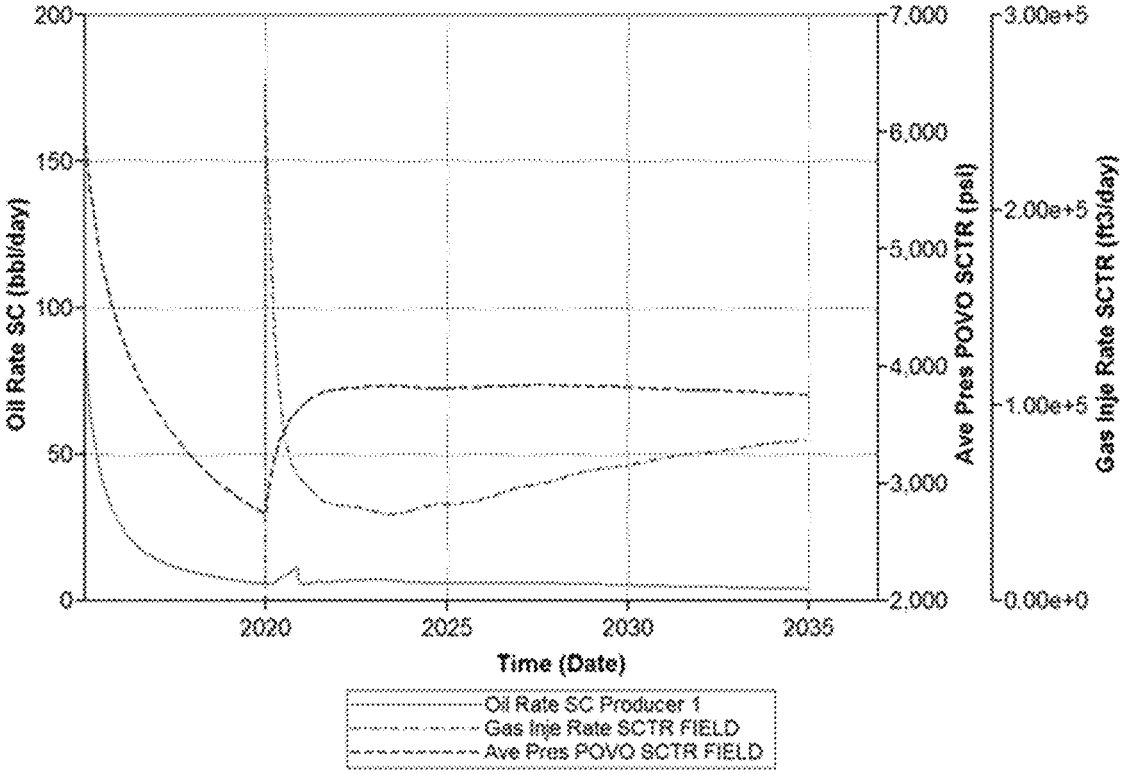
FIG. 8B provides a chart showing the oil production rate, gas injection rate and reservoir pressure over 20 years according to an embodiment of the invention.

FIG. 8A compares oil recovery for the primary production and methane injection cases. FIG. 8B presents oil production rate, gas injection rate and reservoir pressure throughout 20 years for the methane injection case. During the five years of primary production reservoir pressure decreases very quickly. When methane injection starts, pressure increases and is maintained approximately constant due to the gas injection. Oil rate also presents an abrupt decline during the five years of primary production. When methane injection starts, it helps to maintain production rates for a long time.

Figure 9A:
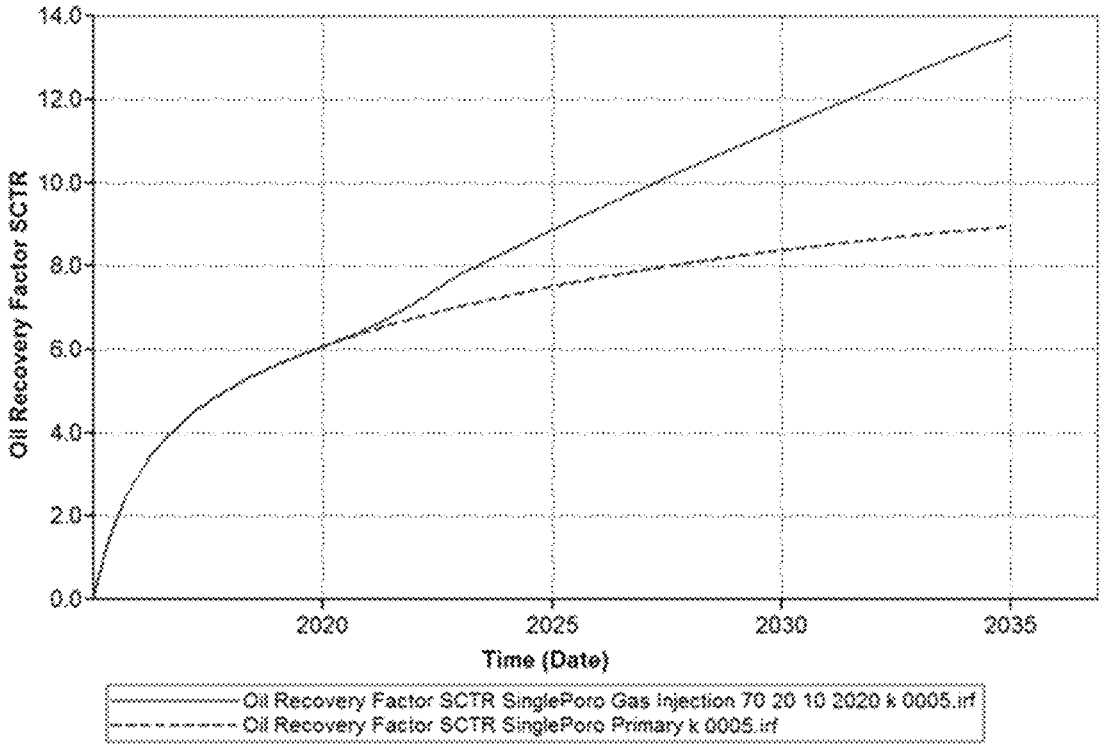
FIG. 9A provides a chart showing the comparative oil recovery with primary production and a hydrocarbon material composition injection according to an embodiment of the invention.
Figure 9B:
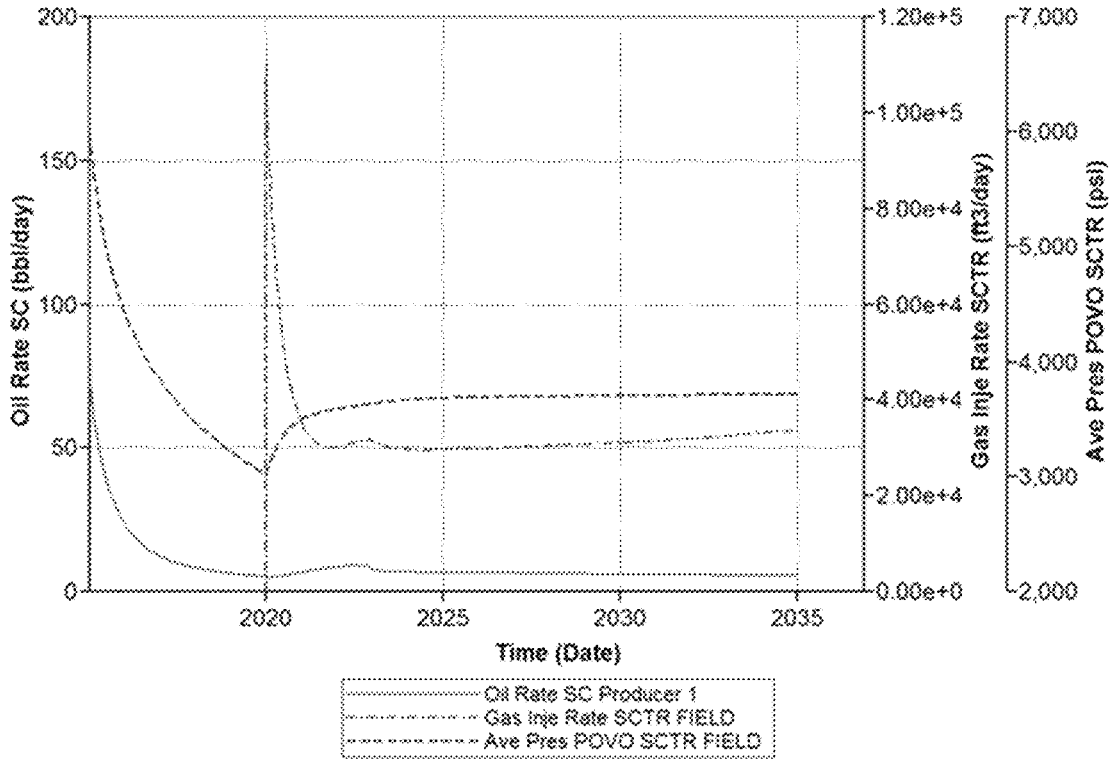
FIG. 9B provides a chart showing the oil production rate, gas injection rate and reservoir pressure over 20 years according to an embodiment of the invention.

FIGS. 9A and 9B present the same kinds of crossplots but for injection case with 70% C1+20% C3+10% C6.

An important issue in an injection project is the time when the injection should start. Two starting times were compared in this study for the case of continuous gas injection: (1) at the beginning of production and (2) after five years of production. For huff and puff gas injection, starting after two years of production was also evaluated. The injected fluid was methane in all cases.

Figure 10A:
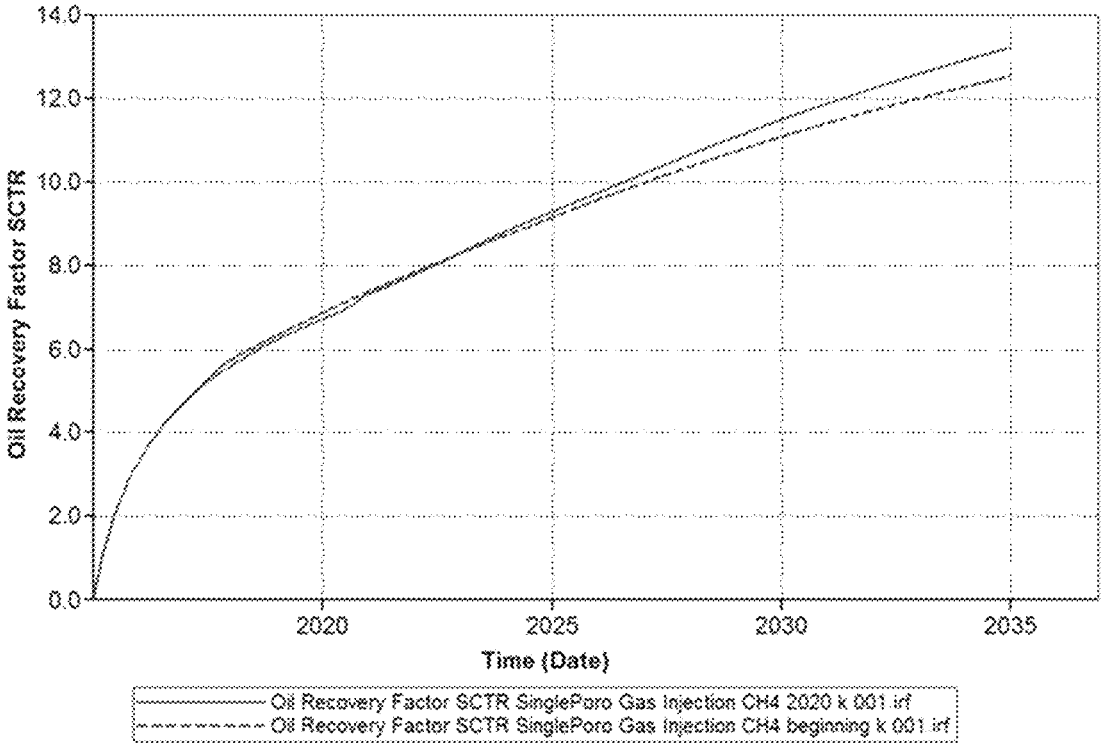
FIG. 10A provides a chart showing how the timing of the commencement of continuous gas injection affects the oil recovery according to an embodiment of the invention.
Figure 10B:
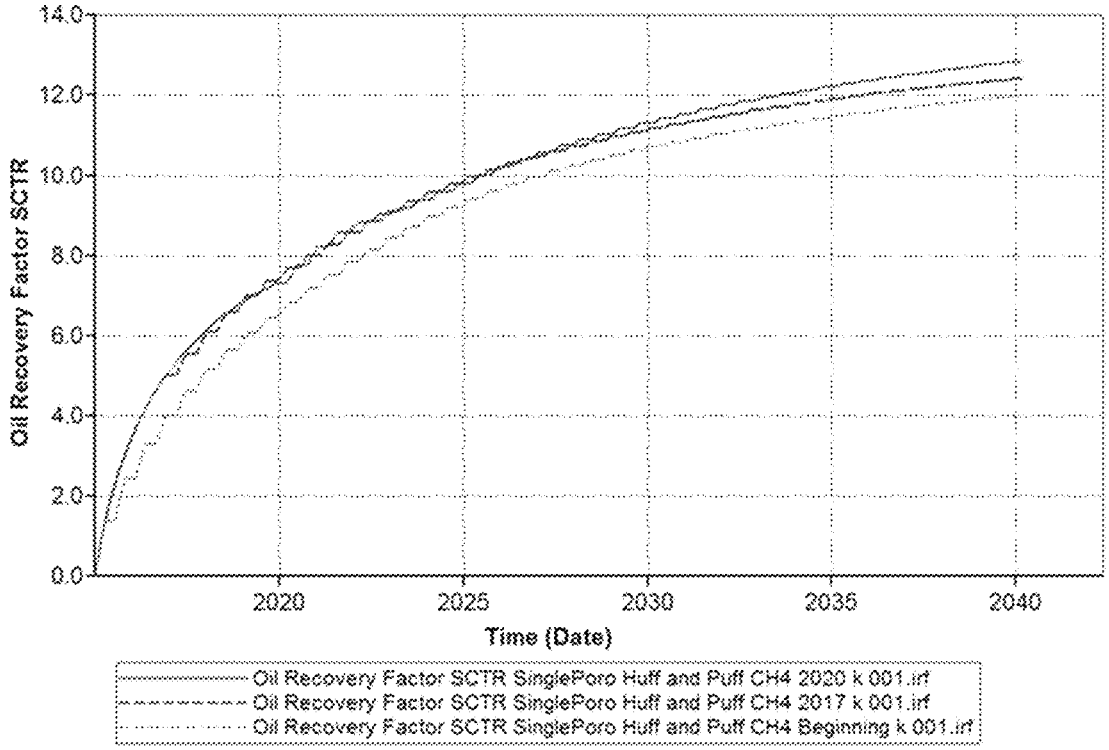
FIG. 10B provides a chart showing how the timing of the commencement of huff and puff gas injection affects the oil recovery, according to an embodiment of the invention.

It was found that starting injection earlier in the production life of the well does not improve oil recoveries in the single porosity model. The best results for both continuous and huff and puff gas injection are obtained when injection starts after five years of production as can be seen in FIGS. 10A and 10B, respectively.

Table 4 compares the oil recovery obtained after 20 years when injection starts after 5 years of primary production. Matrix permeability for the single porosity case is equal to 0.01 millidarcys. The effect of four injected gas compositions was contemplated in this example for different models. It also compares performance with the two injection techniques.

TABLE 4

Oil recovery factors after 20 years of production

| Model | Primary Recovery | Gas Injection: Injected Fluid | Continuous Gas Injection | Huff and Puff |
|---|---|---|---|---|
| Single Porosity | 9.39 | Methane | 13.21 | 12.82 |
| | | 95% C1 + 5% C2 | 13.43 | 12.76 |
| | | 80% C1 + 20% C2 | 14.26 | 12.79 |
| | | 70% C1 + 20% C3 + 10% C6 | 16.80 | 15.42 |

Table 4 shows that continuous gas injection gives slightly better results that huff and puff injection when dealing with a single porosity model, regardless the injected fluid composition. However, it is possible that this increment in oil recovery may not justify the cost of an additional well and the higher volume of gas needed in continuous gas injection. The table also shows that small amounts of C2 added to the injected gas do not improve significantly the oil recovery compared to the 100% methane case. Only when the injected fluid is 70% C1+20% C3+10% C6, can considerable recovery increments be obtained in the single porosity model. Some grade of miscibility with the reservoir oil might be achieved in this case increasing thus the recovery. However, the cost and availability of this gas may be an issue.

Dual Porosity Model

Figure 11:
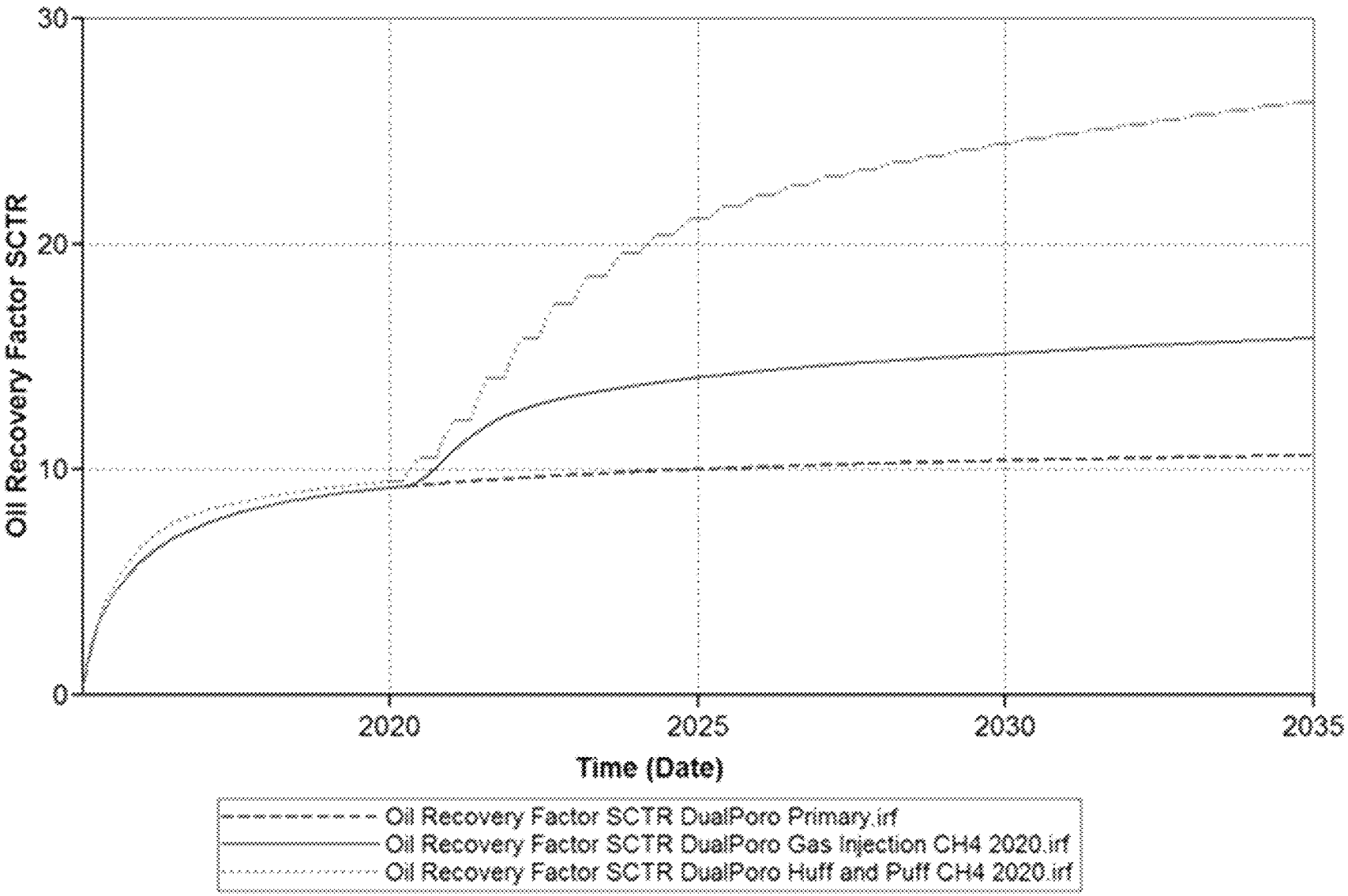
FIG. 11 provides a chart showing how the method of gas injection affects the oil recovery, according to an embodiment of the invention.

The Eagle Ford shale is considered to be a naturally fractured reservoir in many areas. Therefore, dual porosity or dual permeability models are the most suitable to represent the Eagle Ford. FIG. 11 illustrates oil recovery for a dual porosity model when injection starts after five years of primary production. Continuous and huff and puff methane injection cases are included in the figure. The plot shows that when the reservoir is naturally fractured, gas injection can help to improve recoveries in an oil container of the Eagle Ford shale.

Figure 12A:
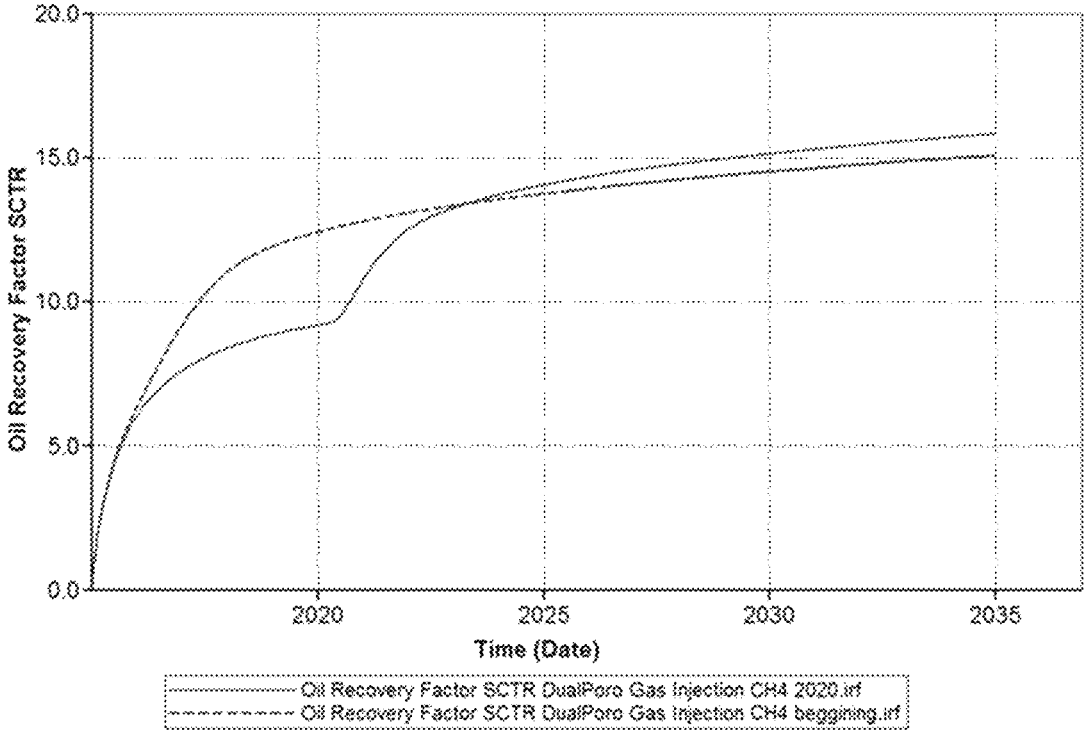
FIG. 12A provides a chart showing how the timing of the commencement of continuous gas injection affects the oil recovery according to an embodiment of the invention.
Figure 12B:
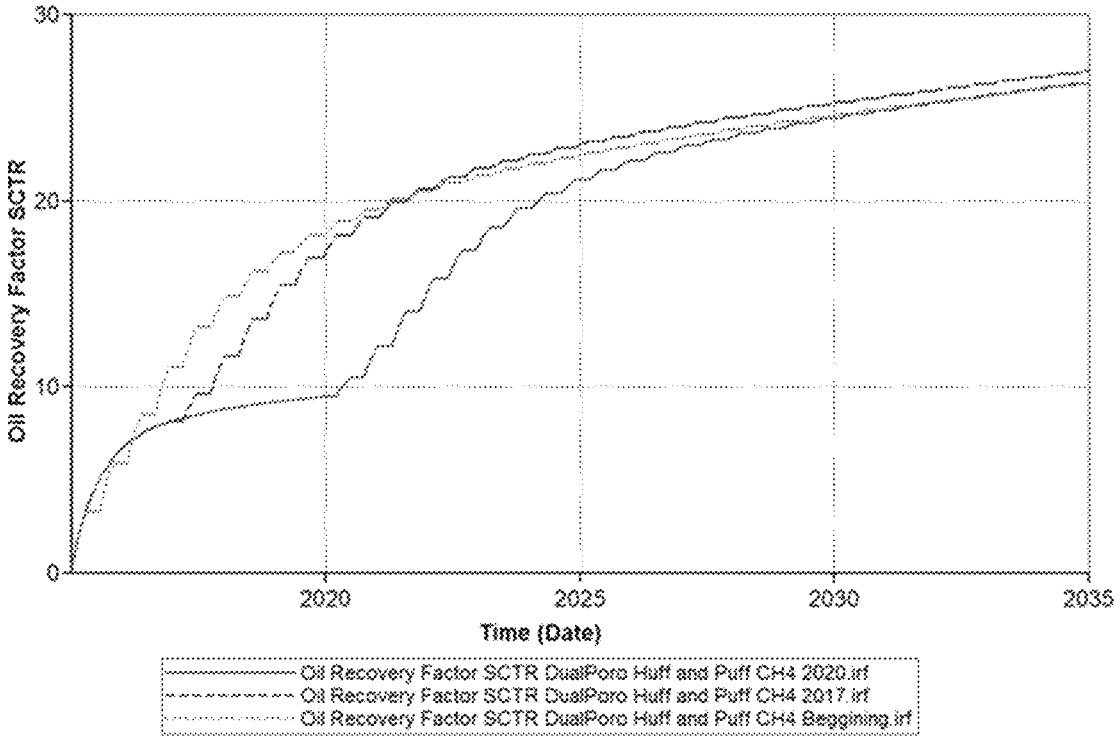
FIG. 12B provides a chart showing how the timing of the commencement of huff and puff gas injection affects the oil recovery, according to an embodiment of the invention.

Different injection starting times were also evaluated with this model. FIG. 12A shows that for continuous gas injection recovery by the year 2035 is higher when injection starts after five years of primary production. However, starting injection at the beginning of production life gives higher early recoveries which may lead to better economic results. From FIG. 12B, it can be concluded that the best time to start the huff and puff gas injection is after two years of production. This time not only gives the highest final oil recovery, but also permits to obtain high early recoveries.

Table 5 compares the oil recovery obtained after 20 years when injection starts after 5 years of primary production. Matrix permeability for the dual porosity model is $2.5\times10^{-4}$ millidarcys. The effect of four injected gas compositions was contemplated in this example for different models. It also compares performance with the two injection techniques.

TABLE 5

Oil recovery factors after 20 years of production

| Model | Primary Recovery | Gas Injection: Injected Fluid | Continuous Gas Injection | Huff and Puff |
|---|---|---|---|---|
| Dual Porosity | 10.62 | Methane | 15.83 | 26.29 |
| | | 95% C1 + 5% C2 | 16.08 | 26.47 |
| | | 80% C1 + 20% C2 | 17.26 | 27.08 |
| | | 70% C1 + 20% C3 + 10% C6 | 40.63 | 32.55 |

When a dual porosity model is used, huff and puff immiscible gas injection generally generates greater recoveries than continuous immiscible gas injection (this is also illustrated in FIG. 11). As in the single porosity model, adding C2 to the injected gas in the double porosity model does not produce substantial improvements in oil production in continuous gas injection or in huff and puff gas injection. An injected gas with composition 70% C1+20% C3+10% C6, which may achieve some grade of miscibility, produces better results than methane. In fact, the recovery obtained with this gas composition is almost 25% more than the recovery using only methane.

Dual Permeability

A dual permeability model was also built in order to study gas injection in the naturally fractured part of an oil container in the Eagle Ford Shale. Input data in both the dual porosity (described above) and dual permeability models are identical.

Figure 13:
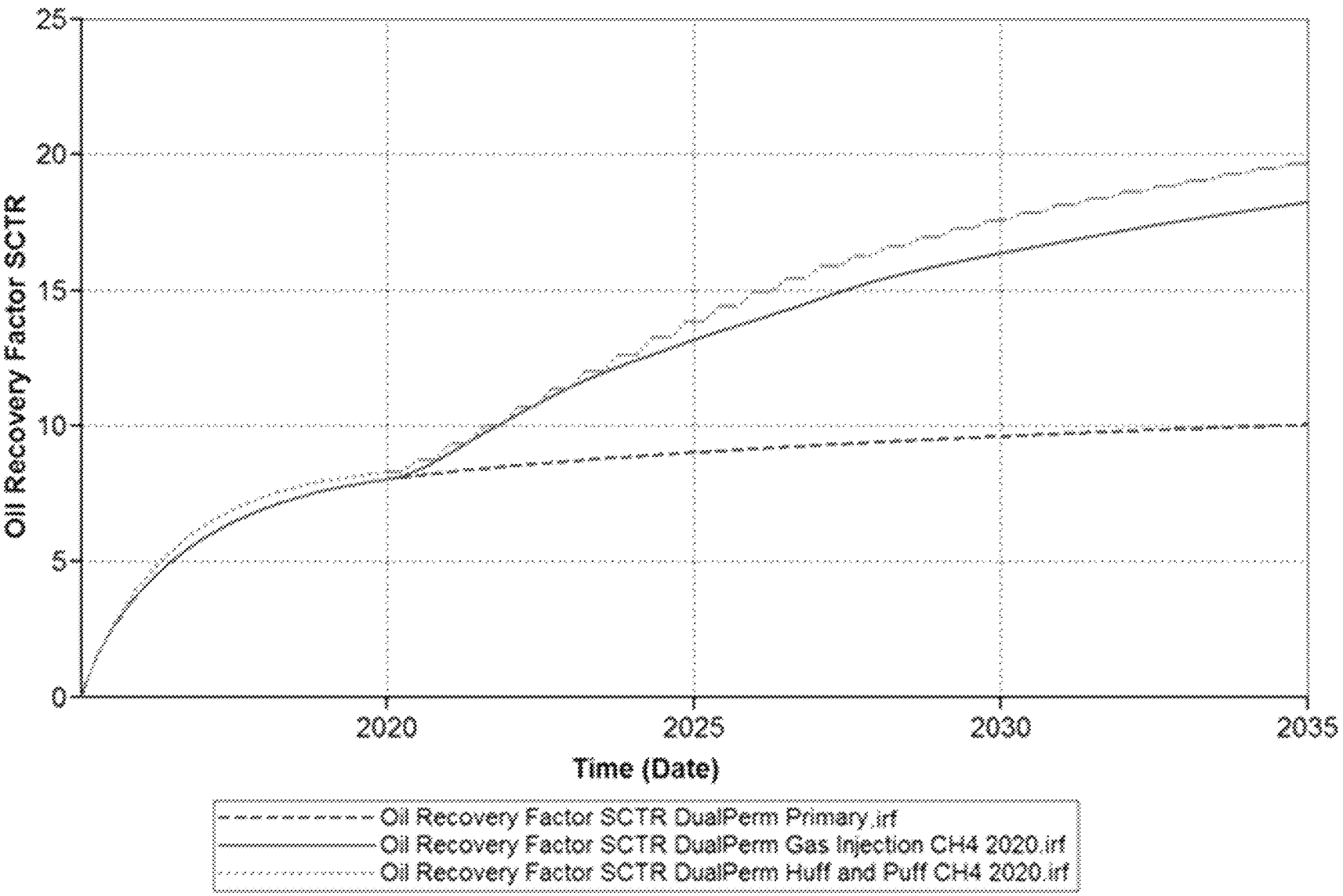
FIG. 13 provides a chart showing how the method of gas injection affects the oil recovery, according to an embodiment of the invention.

FIG. 13 is a plot of oil recovery vs time for the dual permeability model. It shows that, as in the case of the dual porosity model, huff and puff gas injection provides higher recoveries that continuous gas injection when the injection gas is methane.

Table 6 compares the oil recovery obtained after 20 years when injection starts after 5 years of primary production. Matrix permeability for the dual permeability model is $2.5\times10^{-4}$ millidarcys. The effect of four injected gas compositions was contemplated in this example for different models. It also compares performance with the two injection techniques.

TABLE 6

Oil recovery factors after 20 years of production

| Model | Primary Recovery | Gas Injection: Injected Fluid | Continuous Gas Injection | Huff and Puff |
|---|---|---|---|---|
| Dual Permeability | 10.03 | Methane | 18.22 | 19.66 |
| | | 95% C1 + 5% C2 | 18.85 | 19.88 |
| | | 80% C1 + 20% C2 | 20.52 | 20.54 |
| | | 70% C1 + 20% C3 + 10% C6 | 32.83 | 20.96 |

From Table 6 it is concluded that when dealing with a dual permeability model, the effect of fluid composition is important in the continuous gas injection case. The use of a gas that can achieve miscibility (70% C1+20% C3+10% C6) improves the performance compared to the use of only methane. On the other hand, fluid composition variations do not have an important effect on the final recovery obtained by huff and puff gas injection in this model. Table 6 also shows that unlike the dual porosity model, the differences between continuous and huff and puff gas injection results are not pronounced when the injected gas is methane or methane+C2 in the dual permeability model.

Figure 14A:
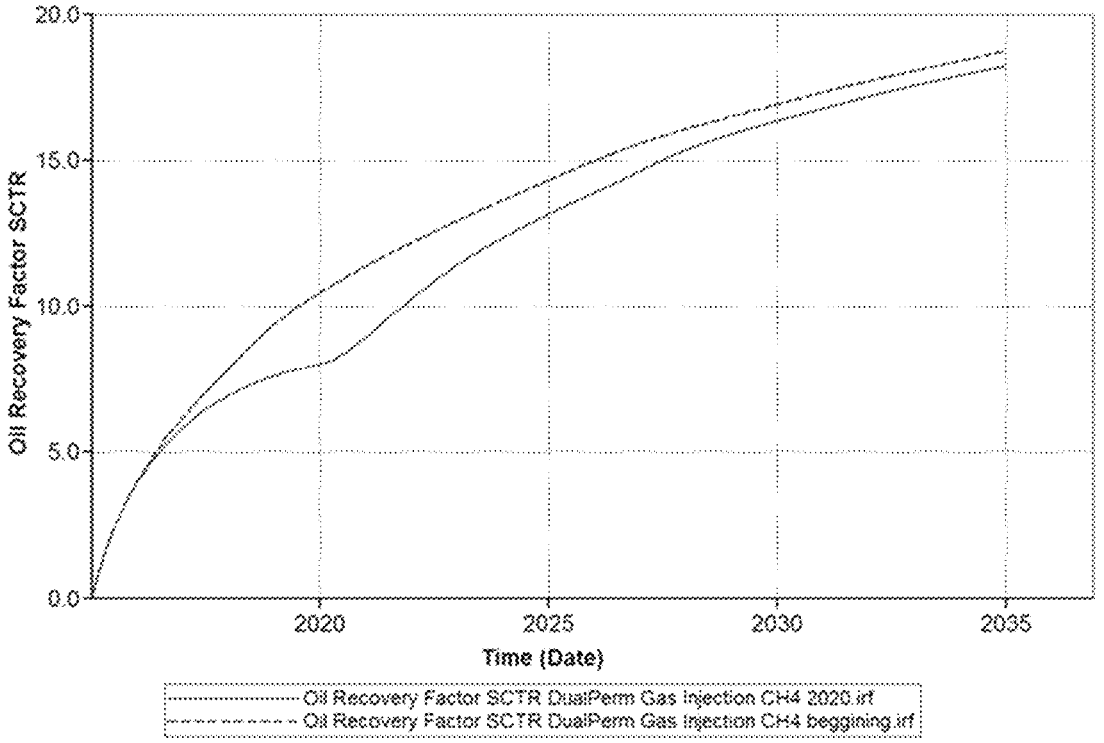
FIG. 14A provides a chart showing how the timing of the commencement of continuous gas injection affects the oil recovery according to an embodiment of the invention.
Figure 14B:
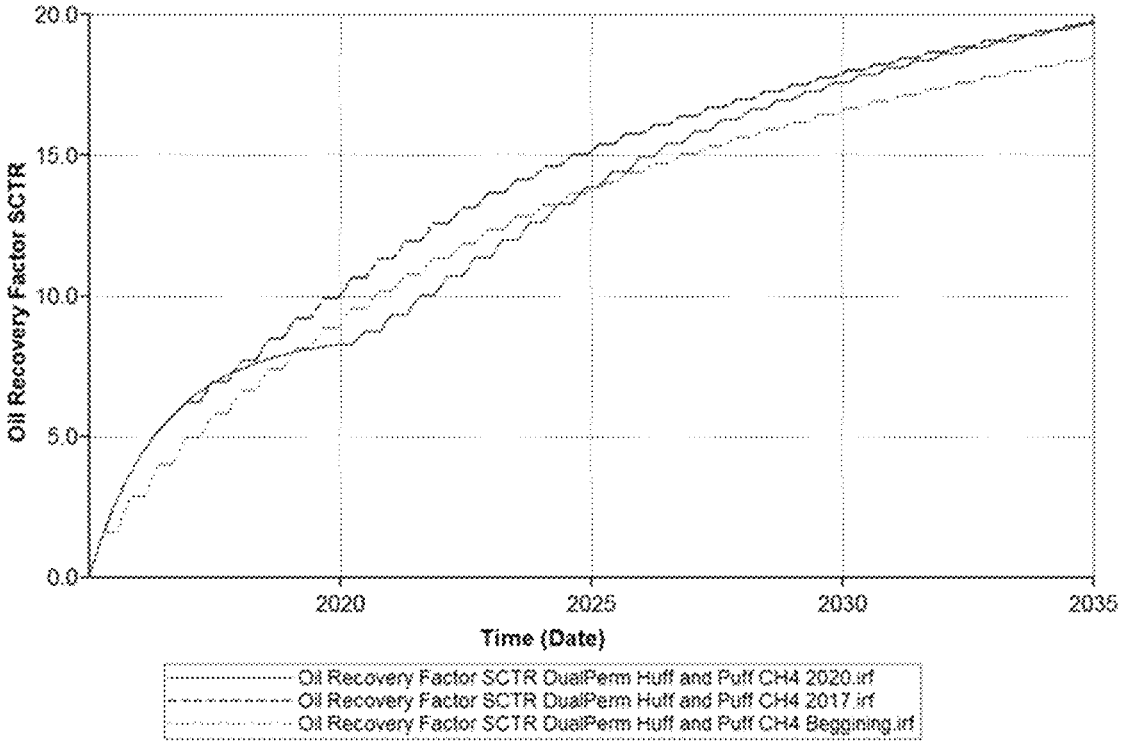
FIG. 14B provides a chart showing how the timing of the commencement of huff and puff gas injection affects the oil recovery, according to an embodiment of the invention.

Starting continuous gas injection at the beginning of production life in the dual permeability model offers a slight increment in the final oil recovery. Furthermore, early recoveries are higher to some extent compared to the case where injection starts after five years of primary production. This can be seen in FIG. 14A. Economic benefits must be evaluated in order to determine which one is the best option. FIG. 14B shows that starting huff and puff injection at the beginning of production is not a good choice. Starting after two years of production, gives the same final recovery as compare with starting after five years. But the early recoveries are moderately higher in the first case. Again, economic considerations must define the best option.

Effect of Diffusion

So far, all simulations in these examples have considered the effects of molecular diffusion. In order to determine the relevance of this phenomenon in the performance of a gas injection project in a shale oil container, additional simulations are done neglecting diffusion effects. Table 7 summarizes the simulations results. In the single porosity model, diffusion does not play an important role in oil recovery by gas injection; increment in oil recovery is almost the same when diffusion occurs and when it is neglected. On the contrary, when the shale is naturally fractured (dual permeability and dual porosity models), diffusion has a significant impact on oil recovery. When diffusion is neglected, the injected gas flows directly to the production well through the fractures instead of penetrating the matrix. This can negatively affect negatively oil production as shown in Table 7. When diffusion occurs, oil recovery may be increased due to transfer of solute from the fractures to the matrix emanating from a concentration gradient. Gas injection may improve oil recovery in fractured shale reservoirs in the absence of diffusion effects when there is miscibility.

TABLE 7

Effect of diffusion on oil recovery by continuous CH4 injection.

| | Without molecular diffusion | | | Molecular diffusion | | |
|---|---|---|---|---|---|---|
| Model | Primary Recovery | Continuous $CH_4$ Injection | RF Increment | Primary Recovery | Continuous $CH_4$ Injection | RF Increment |
| Single Porosity | 9.39 | 12.99 | 3.6 | 9.39 | 13.21 | 3.82 |
| Dual Porosity | 11.06 | 9.54 | −1.52 | 10.62 | 15.83 | 5.21 |
| Dual Permeability | 10.14 | 8.89 | −1.25 | 10.03 | 18.22 | 8.19 |

REFERENCES

The following references are hereby incorporated by reference in their entirety:

Aguilera, R., 2014. Flow Units: From Conventional to Tight-Gas to Shale-Gas to Tight-Oil to Shale-Oil Reservoirs. SPE Reservoir Evaluation and Engineering, Volume 17, No. 02, May 2014.

Aguilera, R. and Aguilera, M. S., 2002, The Integration of Capillary Pressures and Pickett Plots for Determination of Flow Units and Reservoir Containers. SPE Reservoir Evaluation and Engineering, 5(6):465-471. DOI: 10.2118/81196-PA, December 2002.

Altman, R., et al., 2014, Understanding Mechanisms for Liquid Dropout from Horizontal Shale Gas Condensate Wells. Paper SPE 170983 presented at the SPE Annual Technical Conference and Exhibition held in Amsterdam, The Netherlands, 27-29 Oct. 2014.

Fan, L., Martin, R. B., and Thompson, J. W. 2011. An Integrated Approach for Understanding Oil and Gas Reserves Potential in Eagle Ford Shale Formation. Paper SPE 148751 presented at the Canadian Unconventional Resources Conference, held in Calgary, Alberta, Canada, 15-17 Nov. 2011.

Honarpour, M., Nagarajan, N., Orangi, A., Arasteh, F., Yao, Z., 2012. Characterization of Critical Fluid, Rock and Rock Fluid Properties-Impact on Reservoir Performance of Liquid-rich Shales. SPE 158042 presented at the SPE Annual Technical Conference and Exhibition held in San Antonio, Tex., USA, 8-10 Oct. 2012.

Kovscek, A., Tang, G. and Vega, B., 2008. Experimental Investigation of Oil Recovery from Siliceous Shale by $CO_2$. SPE 115679 presented at the 2008 SPE Annual Technical Conference held in Denver, Colo., USA, 21-24 Sep. 2008.

Lopez, B. and Aguilera, R., 2015. Flow Units in Shale Condensate Reservoirs, paper URTeC 2154846 prepared for presentation at the Unconventional Resources Technology Conference (URTeC) in San Antonio, Tex., Jul. 20-22, 2015. DOI 10.15530/urtec-2015, control ID number URTeC 2154846. Published in SPE Reservoir Evaluation & Engineering (2016).

Luo, O. and and Li, S., 2015, Gas Injection in the Bakken Formation: An Overview, Journal of Canadian Petroleum Technology, July 2015.

Railroad Commission of Texas—Eagle Ford Information. (2013). Retrieved Dec. 5, 2013, from https://www.rrc.state.rrc.us/eagleford/

Ramirez, J. and Aguilera, R., 2014. Factors Controlling Fluid Migration and Distribution in the Eagle Ford Shale. SPE 171626-MS presented at the SPE/CSUR Unconventional Resources Conference-Canada held in Calgary, Alberta, Canada, 30 Sep.-2 Oct. 2014. Published in SPE Reservoir Evaluation & Engineering (2016).

Taylor, R. S., Stobo, B., Niebergall, G., Aguilera, R., Walter, J., and Hards, E., 2014. Optimization of Duvernay Fracturing Treatment Design Using Fully Compositional Dual Permeability Numeric Reservoir Simulation. Paper SPE 171602, presented at the SPE/CSUR Unconventional Resources Conference—Canada held in Calgary, Alberta, Canada, 30 Sep.-2 Oct. 2014.

Wan, T., Sheng, J. and Soliman, M., 2013 (a). Evaluation of the EOR potential in shale oil reservoirs by cyclic gas injection. Paper SPWLA-d-12-00119 presented at the SPWLA 54th Annual Logging Symposium Held in New Orleans, La., USA, 22-26 Jun. 2013.

Wan, T., Sheng, J. and Soliman, M., 2013 (b). Evaluation of the EOR potential in fractured shale oil reservoirs by cyclic gas injection. Paper SPE 168880 or URTeC 1611383 presented at the Unconventional Resources Technology Conference Held in Denver, Colo., USA, 12-14 Aug. 2013.

Wan, T. and Sheng, J., 2015. Compositional Modelling of the Diffusion Effect on EOR Process in Fractured Shale-Oil Reservoirs by Gasflooding. Journal of Canadian Petroleum Technology. Volume 54, No. 02, March 2015.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

What is claimed is:

1. A method of producing hydrocarbon material from a formation comprising:

producing a first hydrocarbon material from the formation, the first hydrocarbon material including a gaseous hydrocarbon material originally in place in the formation;

injecting at least a portion of the produced gaseous hydrocarbon material into the formation to increase the formation pressure; and producing a second hydrocarbon material from the formation;

wherein the formation is a shale formation or a tight formation, or the injecting of the at least a portion of the produced gaseous hydrocarbon material is effected for at least 1 month, or the injecting of the at least a portion of the produced gaseous hydrocarbon material is suspended before the producing of the second hydrocarbon material.

2. The method of claim 1, wherein the injected gaseous hydrocarbon material comprises: 70-100 vol % methane; 5-20 vol % ethane; 5-20 vol % propane; and 0-10 vol % hexane, based on the total volume of the injected gaseous hydrocarbon material.

3. The method of claim 1 wherein the injecting of the at least a portion of the produced gaseous hydrocarbon material is effected while the producing of the second hydrocarbon material is being effected.

4. The method of claim 1, wherein the injecting of the at least a portion of the produced gaseous hydrocarbon material is effected for 100 days before the injecting is suspended and the producing of the second hydrocarbon material is effected for 100 days.

5. The method of claim 1 further comprising repeating the injecting of the at least a portion of the produced gaseous hydrocarbon material and the producing of the second hydrocarbon material at least once.

6. The method of claim 1 wherein the injecting of the at least a portion of the produced gaseous hydrocarbon material is into a condensate container disposed in the container, and the producing of the second hydrocarbon material is from the condensate container.

7. The method of claim 6 wherein the injecting increases the pressure in the condensate container to at least the dew point of the second hydrocarbon material.

8. The method of claim 6 wherein the producing of the first hydrocarbon material is from the condensate container disposed within the formation, a gas container disposed within the formation, or a combination thereof.

9. The method of claim 6 wherein the condensate container has a permeability of from about 250 nanodarcys to about 0.1 millidarcys.

10. The method of claim 1, wherein the injecting of the at least a portion of the produced gaseous hydrocarbon material includes injecting into an oil container disposed in the container and the producing of the second hydrocarbon material includes producing from the oil container.

11. The method of claim 10, wherein the injected gaseous hydrocarbon material comprises: 70-100 vol % methane; 5-20 vol % ethane; 5-20 vol % propane; and 0-10 vol % hexane, based on the total volume of the injected gaseous hydrocarbon material.

12. The method of claim 10, wherein the producing of the first hydrocarbon material includes producing from a condensate container disposed within the formation, a gas container disposed within the formation, or a combination thereof.

13. The method of claim 10, wherein the injecting of the at least a portion of the produced gaseous hydrocarbon material decreases the viscosity of the second hydrocarbon material by at least 50% as compared to the initial viscosity of the second hydrocarbon material.

14. The method of claim 10, wherein the oil container has a permeability of from about 0.001 millidarcys to about 0.1 millidarcys.

15. The method of claim 10, further comprising effecting hydraulic fracturing of the oil container prior to production of the first hydrocarbon material.

16. A method of producing hydrocarbon material from a formation comprising:

producing a first hydrocarbon material from the formation, the first hydrocarbon material including a gaseous hydrocarbon material originally in place in the formation;

separating a gas-rich stream from the first hydrocarbon material, injecting at least a portion of the produced gaseous hydrocarbon material into the formation to increase the formation pressure, wherein the injected gaseous hydrocarbon material includes the gas-rich stream; and producing a second hydrocarbon material from the formation.

17. The method of claim 16, wherein the injected gaseous hydrocarbon material comprises: 70-100 vol % methane; 5-20 vol % ethane; 5-20 vol % propane; and 0-10 vol % hexane, based on the total volume of the injected gaseous hydrocarbon material.

18. The method of claim 16 wherein the injecting of the at least a portion of the produced gaseous hydrocarbon material is effected while the producing of the second hydrocarbon material is being effected.

19. The method of claim 16 comprising repeating the injecting of the at least a portion of the produced gaseous hydrocarbon material and the producing of the second hydrocarbon material at least once.

20. The method of claim 16, wherein the injecting of the at least a portion of the produced gaseous hydrocarbon material includes injecting into an oil container disposed in the container and the producing of the second hydrocarbon material includes producing from the oil container.

21. A method of producing hydrocarbon material from a formation comprising:

injecting a gaseous hydrocarbon material into a container disposed within the formation; and producing hydrocarbon material from the container;

wherein the injected gaseous hydrocarbon material comprises: 70-100 vol % methane; 5-20 vol % ethane; 5-20 vol % propane; and 0-10 vol % hexane, based on the total volume of the injected gaseous hydrocarbon material.

22. The method of claim 21 wherein the container is an oil container.

23. The method of claim 21 wherein the container is a condensate container.

24. The method of claim 21 wherein the injected gaseous hydrocarbon material includes gaseous hydrocarbon material originally in place in the formation.

* * * * *